United States Patent [19]

Nakajima

[11] Patent Number: 4,715,631

[45] Date of Patent: Dec. 29, 1987

[54] LIFTING MAGNET UNIT WITH A GRIPPING MECHANISM

[75] Inventor: Shigemi Nakajima, Osaka, Japan

[73] Assignee: Kabushiki Kaisha Nakajima Tekkosho, Osaka, Japan

[21] Appl. No.: 911,079

[22] Filed: Sep. 24, 1986

[30] Foreign Application Priority Data

| | | | |
|---|---|---|---|
| Nov. 29, 1985 | [JP] | Japan | 60-267479 |
| Apr. 17, 1986 | [JP] | Japan | 61-87018 |
| Apr. 17, 1986 | [JP] | Japan | 61-87019 |
| Apr. 22, 1986 | [JP] | Japan | 61-91209 |

[51] Int. Cl.[4] ..... B66C 3/16

[52] U.S. Cl. ..... 294/2; 294/65.5; 414/606

[58] Field of Search ..... 294/2, 65.5; 414/606, 414/737, 744 C; 335/285, 286, 287, 289, 291, 294

[56] References Cited

U.S. PATENT DOCUMENTS

| | | | |
|---|---|---|---|
| 2,850,189 | 9/1958 | Leroy | 414/606 |
| 3,736,018 | 5/1973 | Sayre, Jr. . | |
| 3,795,421 | 3/1974 | Vohl et al. . | |
| 4,502,723 | 3/1985 | Kuromoto . | |

FOREIGN PATENT DOCUMENTS

| | | | |
|---|---|---|---|
| 174642 | 4/1905 | Fed. Rep. of Germany . | |
| 501512 | 4/1929 | Fed. Rep. of Germany . | |
| 2426359 | 5/1974 | Fed. Rep. of Germany . | |
| 737135 | 12/1932 | France . | |
| 2049627 | 3/1971 | France . | |
| 107148 | 10/1923 | Switzerland . | |
| 958539 | 5/1964 | United Kingdom . | |
| 590239 | 7/1978 | U.S.S.R. | 294/65.5 |

*Primary Examiner*—James B. Marbert

*Attorney, Agent, or Firm*—Balogh, Osann, Kramer, Dvorak, Genova & Traub

[57] ABSTRACT

A lifting magnet with a gripping mechanism generally comprises a lifting magnet capable of electrically magnetized for gathering and attracting magnetic articles, such as scraps of dismantled machines, broken automobiles and electric washing machines, a main power cylinder, and a plurality of gripping arms mounted on the lifting magnet and each comprising a first arm pivotally joined at one end to the lifting magnet, a second arm pivotally joined at one end to the other end of the first arm, an auxiliary power cylinder for operating the first arm for gripping operation, and locking means for locking the second arm to the first arm when the first and second arms are folded and when the second arm is opened relative to the first arm for gripping operation. In one aspect of the present invention, only two among a plurality of the gripping arm assemblies can be used for gripping elongate articles. In another aspect of the present invention, the assembly of the lifting magnet and the gripping arm assemblies is suspended from a rotative driving mechanism so as to be turned about a vertical axis so that the gripping arm assemblies are located properly over articles to be lifted. When the gripping arm assemblies need not operate, the gripping arm assemblies are folded and stored on the lifting magnet.

14 Claims, 69 Drawing Figures

LIFTING MAGNET UNIT WITH A GRIPPING MECHANISM

BACKGROUND OF THE INVENTION

The present invention relates to a lifting magnet unit with a gripping mechanism to be hung on a crane for lifting and transporting used articles recovered for recycling from industrial waste, dismantled machines and broken buildings and structures.

The elemctromagnetic attraction of a conventional lifting magnet decreases due to the reduction of the current that flows through the solenoid resulting from increase in the resistance of the solenoid when the temperature of the solenoid rises. Accordingly, the lifting capacity of the lifting magnet varies greatly depending on the variation of the ambient temperature. The variation of the lifting capacity of the lifting magnet is remarkable particularly in lifting junk including miscellaneous articles of various materials, such as domestic waste articles including electric washing machines and electric fans, dismantled automotive bodies, disassembled light shape steels and entangled reinforcing bars of broken reinforced concrete structures. There are two ordinary means for lifting and transporting such articles and materials hard to handle, namely, employing, in combination, a crane equipped with a lifting magnet and a crane equipped with a gripping mechanism, and alternately and selectively using a lifting magnet and a gripping mechanism on a single crane according to the purpose.

Among such conventional means, the former requires an increased investment in two cranes, while the latter requires much time and work for replacing the lifting magnet and the gripping mechanism, and hence effective working time is reduced. Furthermore, the installation of two individual cranes in a narrow working space makes lifting and transporting work difficult.

SUMMARY OF THE INVENTION

Accordingly, it is an object of the present invention to provide a lifting magnet unit with a gripping mechanism, capable of being hung on a crane and capable of operating in three modes, namely, a mode in which only the lifting magnet is used, a mode in which only the gripping mechanism is used and a mode in which both the lifting magnet and the gripping mechanism are used in combination.

It is another object of the present invention to provide a lifting magnet unit with a gripping mechanism capable of operating in a space where the lifting space is restricted because of the low height of ceiling of the building in which the crane is operated and the high loading height of the truck.

It is a further object of the present invention to provide a lifting magnet unit with a gripping mechanism, capable of gripping a large amount of articles loaded on the narrow body of a truck after being lowered into the body without widely opening the gripping arms.

It is an even further object of the present invention to provide a lifting magnet unit with a gripping mechanism, having four gripping arms, and capable of easily changing the number of operating gripping arms from four to two for gripping elongate articles and from two to four for gripping other miscellaneous articles.

According to one aspect of the present invention, a lifting magnet unit with a gripping mechanism comprises a lifting magnet; a bracket attached to the upper surface of the lifting magnet opposite the attracting surface of the same; a screw rod supported upright and rotatably at one end on the bracket; a base plate disposed at the other end of the screw shaft; a motor for rotating the screw rod, disposed on the base plate; a frame fixed at the lower end to the bracket and at the upper end to the base plate; a spider block having an internally threaded center hole engaging the screw rod; and a plurality of gripping arm assemblies each comprising a first arm pivotally joined at one end thereof to the extremity of one of the arms of the bracket with a pin, a second arm pivotally joined at one end thereof to the other end of the first arm with a pin, a rod pivotally joined at one end thereof to the spider block with a pin and at the other end thereof to the middle part of the first arm with a pin, a pin which engages a hole formed in the second arm to fix the second arm to the first arm, and an electromagnet for driving the pin.

According to another aspect of the present invention, a lifting magnet unit with a gripping mechanism comprises a lifting magnet which produces an attraction when magnetized and loses the attraction when demagnetized; a plurality of gripping arm assembles each comprising a first arm pivotally joined at one end to the lifting magnet, a second arm pivotally joined to the other end of the first arm and capable of folding over or into the first arm, and a locking mechanism for locking the second arm to the first arm; a main power cylinder unit disposed on the upper surface of the lifting magnet; a plurality of auxiliary power cylinder units each having a cylinder pivotally joined to the main power cylinder unit, and a piston rod pivotally joined to the first arm; a crossshaped trunnion disposed above the main power cylinder unit for swingably suspending the gripping arm assemblies and the lifting magnet; and a rotative driving mechanism detachably joined to the cross-shaped trunnion for turning the gripping arm assemblies and the lifting magnet.

According to a further aspect of the present invention, a lifting magnet unit with a gripping mechanism comprises a lifting magnet which produces an attraction when magnetized; a main power cylinder unit pivotally joined at the lower end to the upper surface of the lifting magnet; a four-arm spider block fixed to the free end of the piston rod of the main power cylinder unit; auxiliary power cylinder units each having a cylinder pivotally joined at one end to the four-arm spider block; and gripping arm assembles each comprising a first arm pivotally joined at one end to the lifting magnet and at the middle part to the free end of the piston rod of the auxiliary power cylinder unit, a second arm pivotally joined at one end to the other end of the first arm and capable of folding over the first arm, and a locking mechanism for locking the second arm to the first arm.

According to an even further aspect of the present inventiion, a lifting magnet unit with a gripping mechanism comprises a lifting magnet which produces an attraction when magnetized; a main power cylinder unit joined to the upper surface of the lifting magnet; a spider bracket fixed to the free end of the piston rod of the main power cylinder unit; auxiliary power cylinder units; and gripping arm assemblies each comprising a first arm pivotally joined at one end to the lifting magnet, a second arm pivotally joined to the other end of the first arm, and a hydraulic unit for turning the second arm relative to the first arm.

According to a still further aspect of the present invention, a lifting magnet unit with a gripping mechanism comprises a lifting magnet which produces an attraction when magnetized; a main power cylinder unit joined to the upper surface of the lifting magnet; a lower spider block fixed to the free end of the piston rod of the main power cylinder unit; an upper spider block capable of being detachably joined to the lower spider block; an upper spider block operating mechanism for joining the upper spider block to and for disjoining the same from the lower spider block; gripping arm assemblies each comprising a first arm pivotally supported at one end on the lifting magnet, a second arm pivotally joined at one end to the other end of the first arm, an auxiliary power cylinder unit having a cylinder pivotally joined at one end to the upper or lower spider block and a piston rod pivotally joined at the free end to the first arm, and a locking mechanism for locking the second arm to the first arm.

The above and other objects, features and advantages of the present invention will become more apparent from the following description of the preferred embodiment thereof taken in conjunction with the accompanying drawings.

DESCRIPTION OF THE PREFERRED EMBODIMENT

Figure 1:
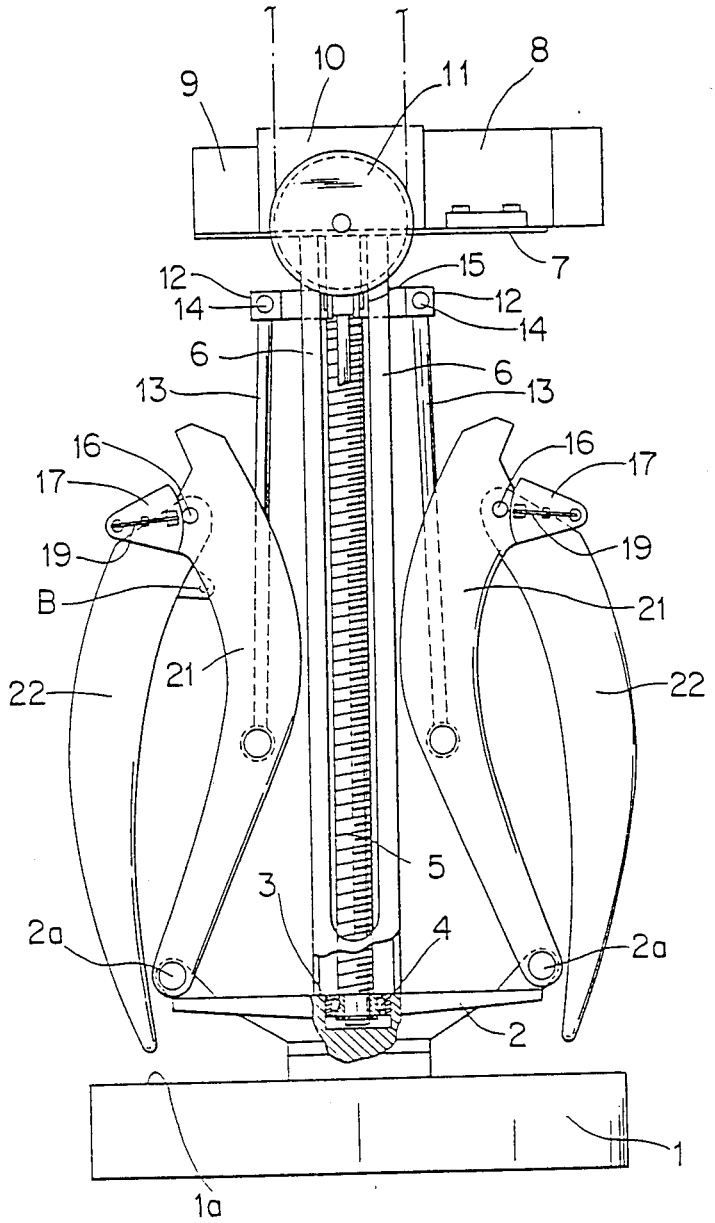
FIG. 1 is an elevational view partly in section of a first embodiment of the present invention.
Figure 2A:
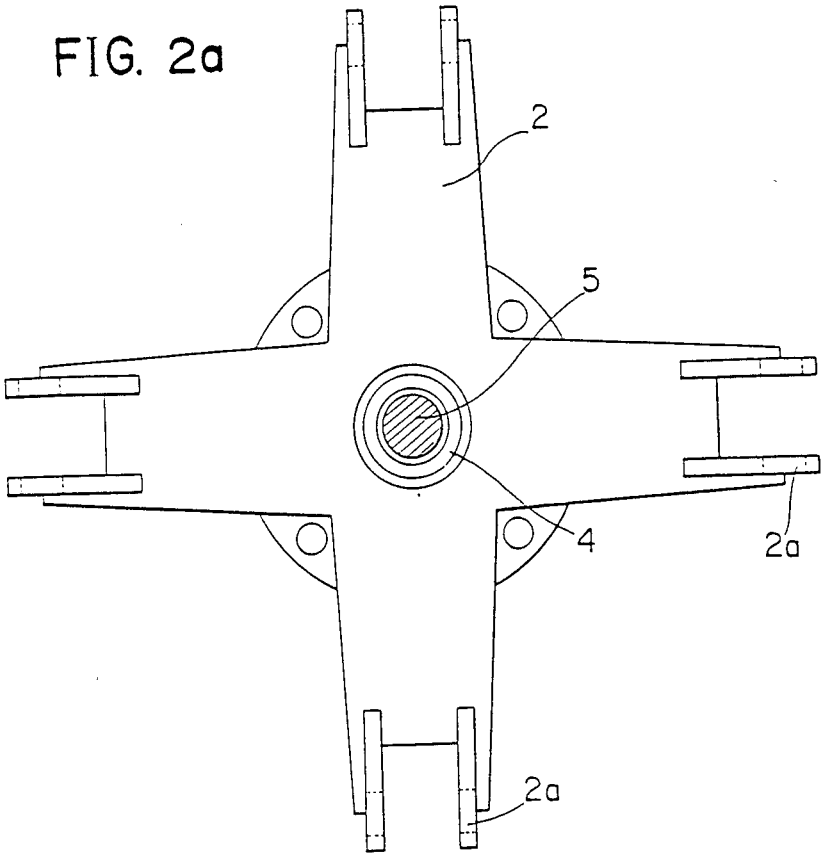
FIGS. 2*a* and 2*b* are plan view and a sectional view, respectively, of a spider bracket employed in the first embodiment.
Figure 2B:
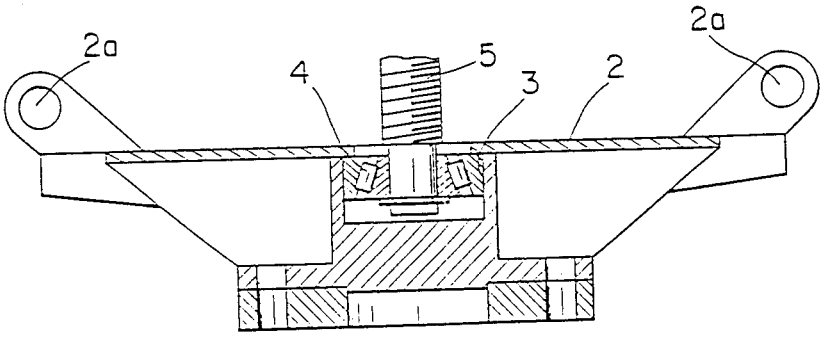
Figure 3:
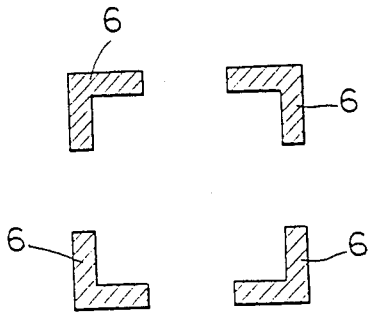
FIG. 3 is a sectional view of a frame employed in the first embodiment.

A lifting magnet unit with a gripping mechanism, in a first embodiment, according to the present invention is a combination of a lifting magnet 1 and four gripping arm assemblies. Referring to FIGS. 1, *2a* and *2b*, a cross-shaped bracket 2 having four arms each having a knuckle formed at the extremity thereof and supporting a pivot pin *2a* is fixed to the upper surface *1a* of the lifting magnet 1, and a screw rod 5 is supported upright and rotatably at the lower end thereof in a thrust bearing 4 fitted in the center hole 3 of the bracket 2. Four legs 6 having an L-shaped cross section are erected around the screw rod 5 in a substantially rectangular arrangement with gaps therebetween as illustrated in FIG. 3 and are fixed at the lower ends to the upper surface of the bracket 2. The gaps between the adjacent legs 6 coincide with the four arms of the bracket 2, respectively. A base plate 7 is joined firmly to the upper ends of the legs 6 with side plates. A motor 8, a switch box 9 and a reduction gear 10 are disposed on the base plate 7. Sheaves 11 to be suspended from the hook of a crane are provided on the side plates. The rotative force of the motor 8 is transmitted through the reduction gear 10 to the screw rod 5. A spider block 15 having four radial arms is screwed on the screw rod 5 so as to be moved vertically by rotating the screw rod 5.

Figure 4:
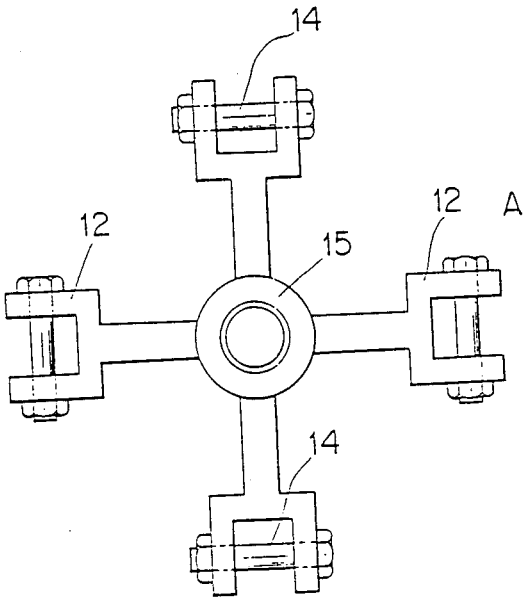
FIG. 4 is a plan view of a spider block employed in the first embodiment.

As illustrated in FIG. 4, the four radial arms of the spider block 15 extend radially through the gaps between the adjacent legs 6, respectively. A knuckle 12 is formed in the extremity of each radial arm of the spider block 15, and a pin 14 is supported on each knuckle 12.

Figure 6:
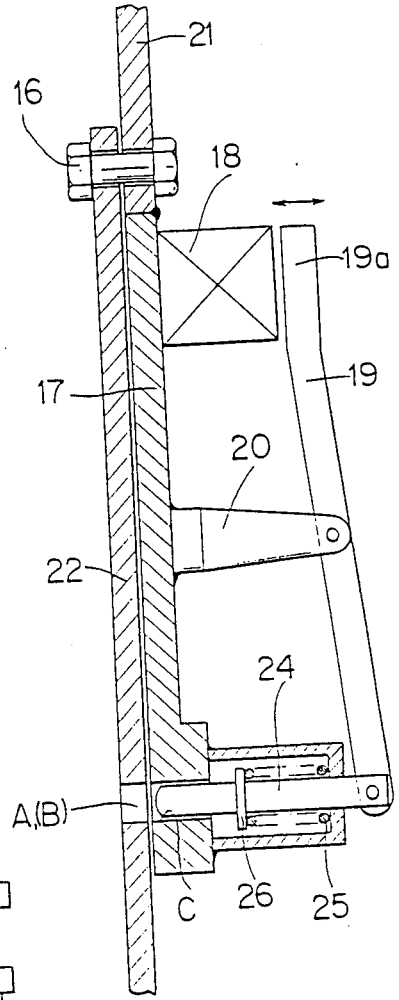
FIG. 6 is a sectional view of the sector plate and the associated members.
Figure 5:
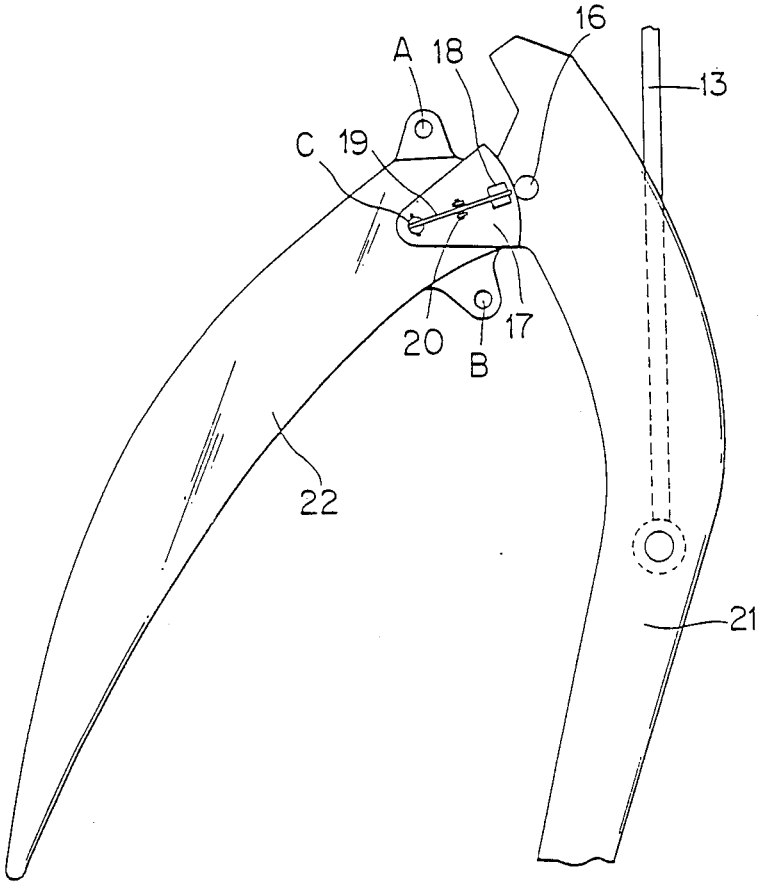
FIG. 5 is a fragmentary side elevation of assistance in explaining the relative disposition of a first arm, a second arm and a sector plate.
Figure 7A:
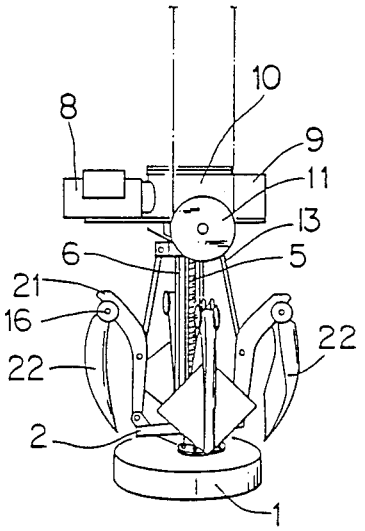
FIGS. 7*a*, 7*b* and 7*c* are perspective views of the first embodiment in different phases of operation.
Figure 7B:
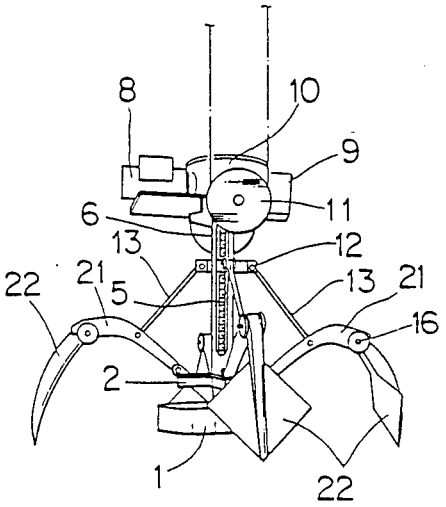
Figure 7C:
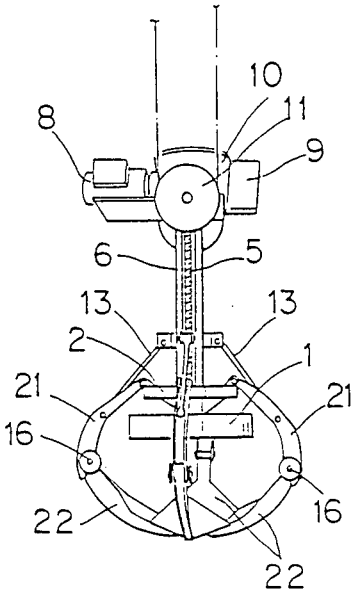

As illustrated in FIGS. 5 and 6, a gripping arm assembly has a first arm 21 and a second arm 22. The first arm 21 is joined pivotally to the knuckle of the bracket 2 with a pin *2a*. A connecting rod 13 is joined pivotally at one end to the middle part of the first arm 21 and at the other end to the knuckle 12 of the spider block 15 with a pin 14. The second arm 22 is joined pivotally at one end to one end of the first arm 21 with a pin 16 and is provided with holes A and B for securing the second arm 22 to the first arm 21 with a pin. A sectoral plate 17 is partly fixed to the side surface of the first arm 21 so as to be in sliding contact with the side surface of the second arm 22 when the first arm 21 turns on the pin *2a*. As illustrated in FIG. 6, the sectoral plate 17 is provided with a solenoid 18 in the upper portion, a lever 19 pivotally supported at the middle part by a supporting leg 20 with one end thereof disposed near the solenoid 18, a pin 24 pivotally joined to the other end of the lever 19, a hole C for receiving the pin 24 therethrough, and a spring 25 biasing the pin 24 toward the hole C. When the solenoid is energized, the lever 19 is turned counterclockwise, as viewed in FIG. 6, on the supporting leg 20. When the hole C of the sectoral plate 17 coincides with the hole A or B of the second arm 22, the pin 24 is inserted into the hole A or B of the second arm 22 by the resilience of the spring 25, so that the second arm 22 is locked to the first arm 21.

The manner of operation of the lifting magnet unit with a gripping mechanism thus constituted will be described hereinafter.

(a) Use of only the lifting magnet:

The screw rod 5 is rotated to raise the spider block 15 to the uppermost position, and thereby the first arms 21 are turned on the pins *2a* through the connecting rods 13. Upon the coincidence of the holes C of the sectoral plates 17 with the holes A of the corresponding second arms 22, the pins 24 are inserted through the holes C into the holes A, respectively, to secure the second arms 22 to the corresponding first arms 21, respectively, as illustrated in FIG. *7a*, so that the gripping arm assemblies are folded for lifting operation only by means of the lifting magnet 1.

(b) Use of both the lifting magnet and the gripping arm assemblies:

In a state as shown in FIG. *7a*, the solenoids 18 are energized to turn the levers 19 by attracting one end *19a* of each lever 19 so that the pins 24 pivotally joined to the other end of each lever 19 are pulled out from the holes A, respectively, against the resilience of the springs 25. Then, the motor 8 is energized to move the spider block 15 downward so that the first arms 21 are turned on the pins *2a* as far as the holes C coincides with the holes B of the second arms 22, respectively. As the first arms 21 are turned, the free ends of the pins 24 slide along the side surfaces of the second arms 22, and upon the coincidence of the holes C with the holes B of the second arms 22, the pins 24 are inserted automatically into the holes B of the second arms 22 by the resilience of the springs 25, respectively, so that the second arms 22 are secured to the first arm 21, respectively, as illustrated in FIG. *7b*. In this state, the crane is operated to bring the gripping arm assemblies over articles, and then the motor 8 is actuated to move the spider block 15 further downward to close the gripping arm assemblies in a state as illustrated in FIG. *7c*, so that the articles are gripped with the gripping arm assemblies and, at the same time, are attracted by the lifting magnet 1. The spider block 15 is raised to a predetermined upper position to open the gripping arm assemblies as illustrated in FIG. *7b*.

(c) Use of only the gripping arm assemblies:

In the operating mode of (b), the lifting magnet is demagnetized and only the gripping arm assemblies are used.

Although the invention has been applied to a lifting magnet with a gripping mechanism having four gripping arm assemblies, and hence the bracket 2, the legs 6 and the spider block 15 of the first embodiment are formed so as to be suitable for mounting four gripping arm assemblies. However, the number of the gripping arm assemblies is not limited to four, but may be an optional number, such as two or three, and may be varied optionally according to the objective articles and the form of the bracket, legs and the spider block may be varied accordingly.

A second embodiment of the present invention will be described hereinafter.

Figure 8:
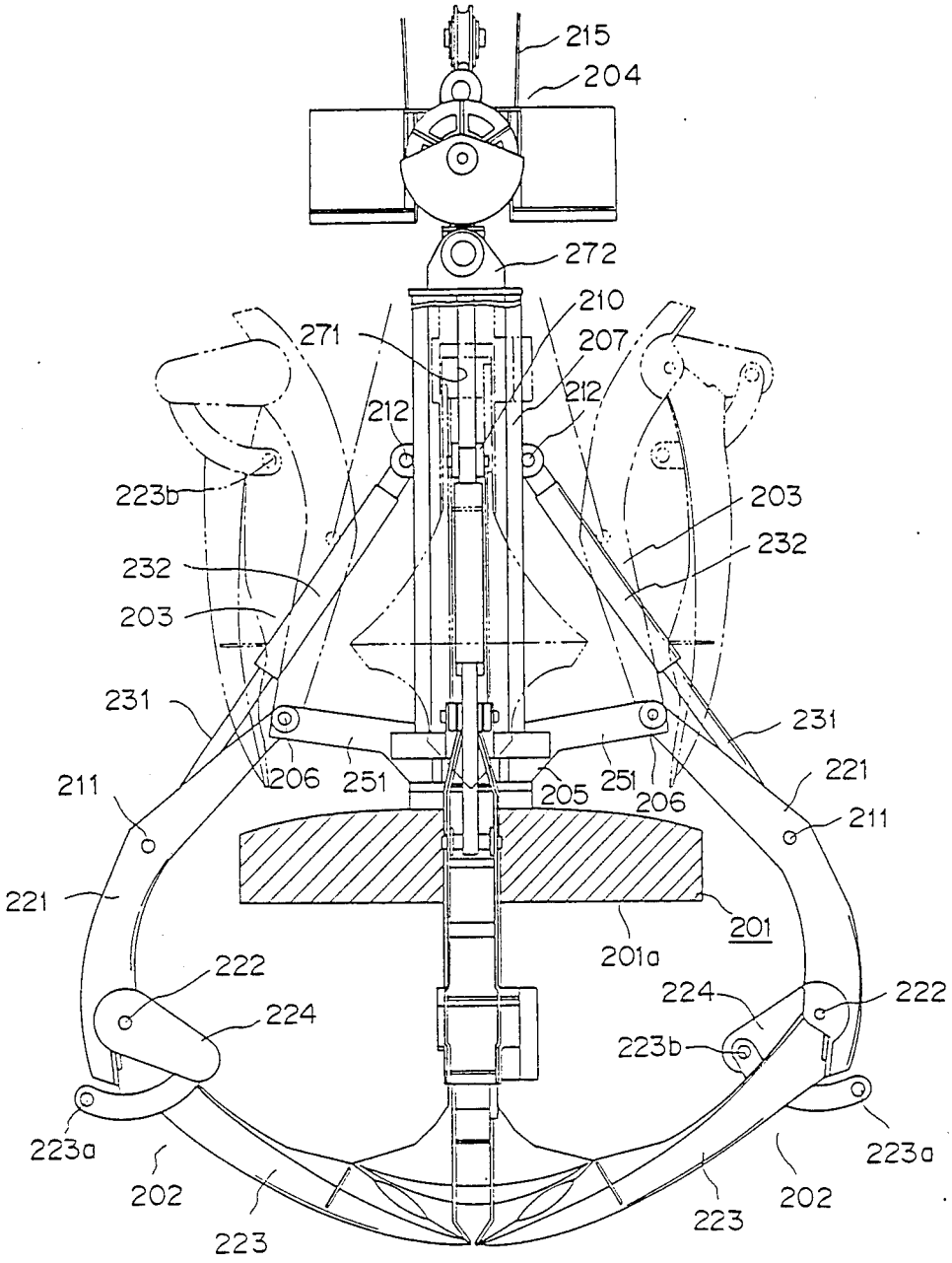
FIG. 8 is a general elevational view partly sectional of a second embodiment of the present invention.
Figure 9:
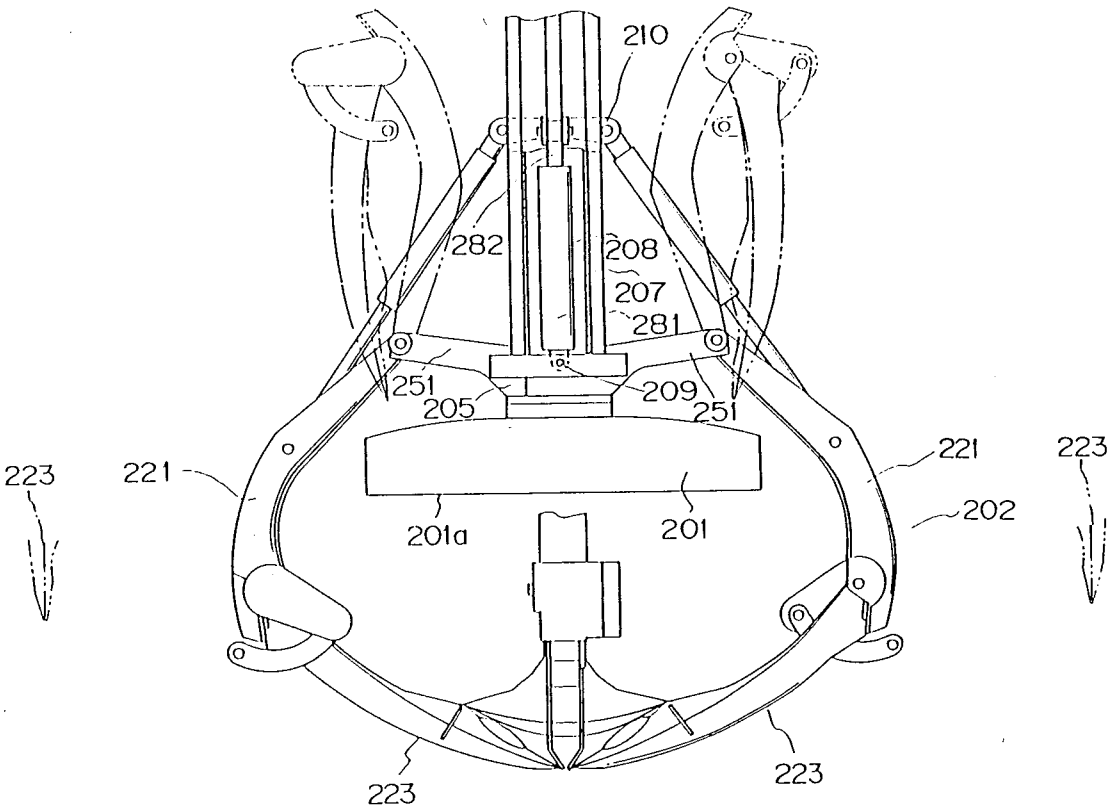
FIG. 9 is a fragmentary elevational view of the second embodiment.

Referring to FIGS. 8 and 9, the second embodiment comprises, generally, a lifting magnet 201, gripping arm assemblies 202 each having a first arm 221 and a second arm 223, a main power cylinder 208, and auxiliary power cylinders 203. The main power cylinder 208 and the auxiliary power cylinders 203 are actuated for folding and operating the gripping arm assemblies 202.

The assembly of the lifting magnet 201 and the gripping arm assemblies 202 is detachably joined to the rotative driving mechanism 204 having sheaves 213 suspended from a hook, not shown, of a crane, for swiveling motion.

Figure 11A:
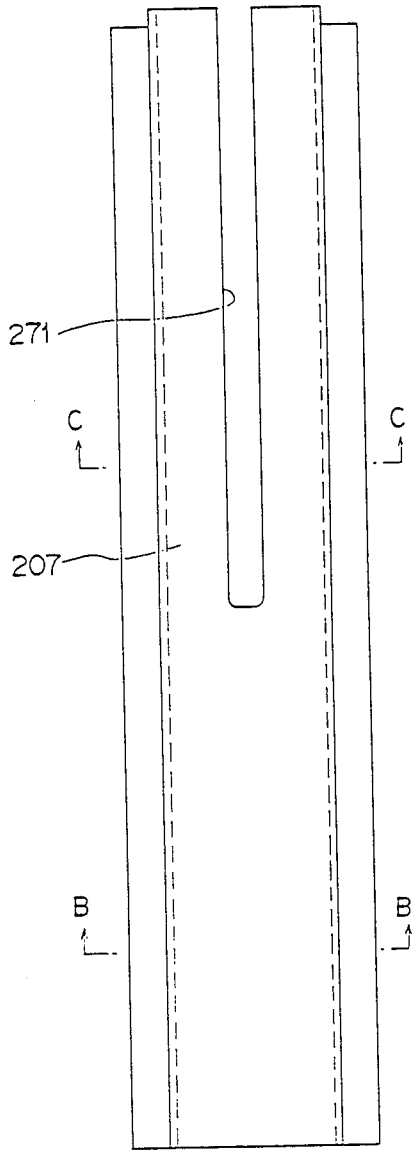
FIG. 11*a* is a front elevation of a main column of the second embodiment.
Figure 11B:
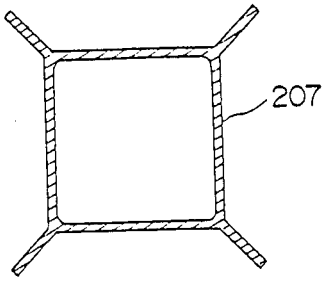
FIG. 11*b* is a cross-sectional view taken on line B—B of FIG. 11*a;*
Figure 11C:
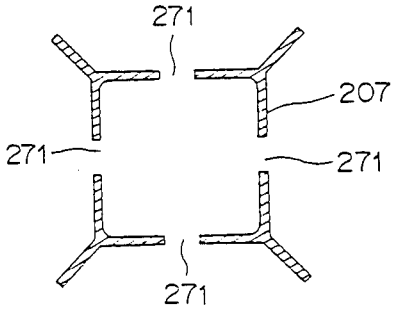
FIG. 11*c* is a cross-sectional view taken on line C—C of FIG. 11*a;*
Figure 12A:
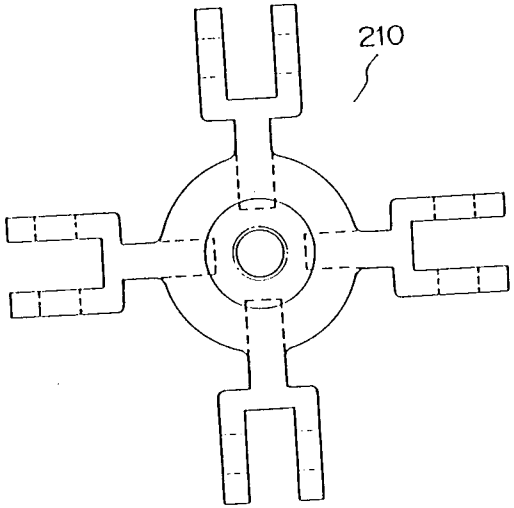
FIG. 12*a* is a plan view of a movable spider block of the second embodiment.
Figure 12B:
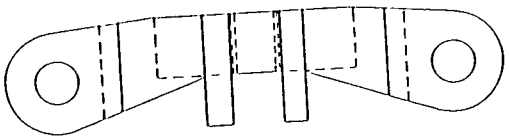
FIG. 12*b* is a side elevation of the movable spider block of FIG. 12*a;*

The substantially disk-shaped lifting magnet 201 has a flat lower surface serving as an attracting surface 201*a*. A bracket 205 is provided in the central portion of the upper surface of the lifting magnet 201. A main column 207 substantially having the shape of a square tube as illustrated in FIGS. 11*a*, 11*b* and 11*c*, is fixed at the lower end to the central portion of the bracket 205, in an upright position by welding or the like. The main power cylinder 208 is disposed inside the main column 207. In this embodiment, the main power cylinder 208 and the auxiliary power cylinders 203 are hydraulic cylinders. The lower end of the cylinder 281 of the main power cylinder 208 is joined to the central part of the bracket 205 with a pin 209 (FIG. 9). A spider block 210 (FIGS. 12*a* and 12*b*) is secured to the free end of the piston rod 282 of the main power cylinder 208 with fixing means as lock nuts. The spider block 210 is moved vertically along guide grooves 271 formed in the upper half section of the main column 207 by the main power cylinder 208.

Figure 10:
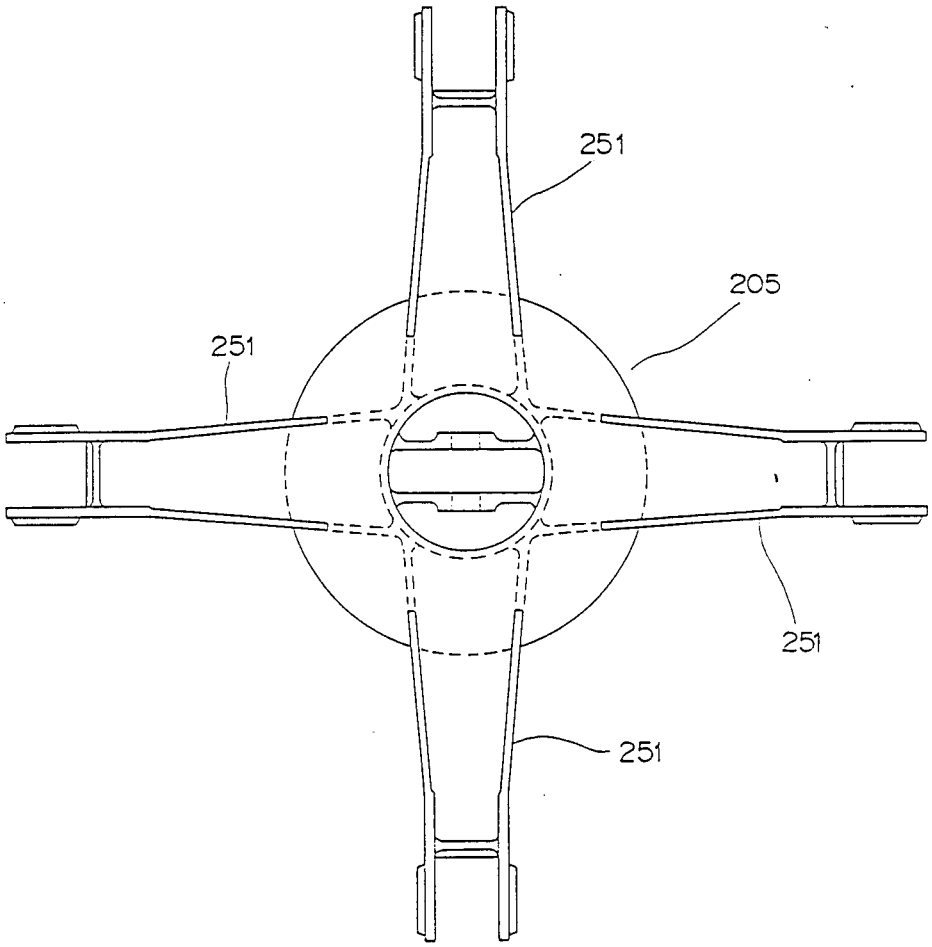
FIG. 10 is a plan view of a main spider bracket of the second embodiment.

As illustrated in FIG. 10, the bracket 205 has four arms 251 extending radially in a cross shape. The first arm 221 is joined pivotally at one end to the extremity of the arm 251 with a pin 206. The free end of the piston rod 231 of the auxiliary power cylinder 203 is joined pivotally to the middle part of the first arm 221 with a pin 211. The free end of the cylinder 232 of the auxiliary power cylinder 203 is joined pivotally to the spider block 210 with a pin 212.

Each gripping assembly 202 comprises the first arm 221 the second arm 223 pivotally joined to the other end of the first arm 221 with a pin 222, and a locking mechanism 224 for locking the second arm 223 to the first arm 221.

Figure 13B:
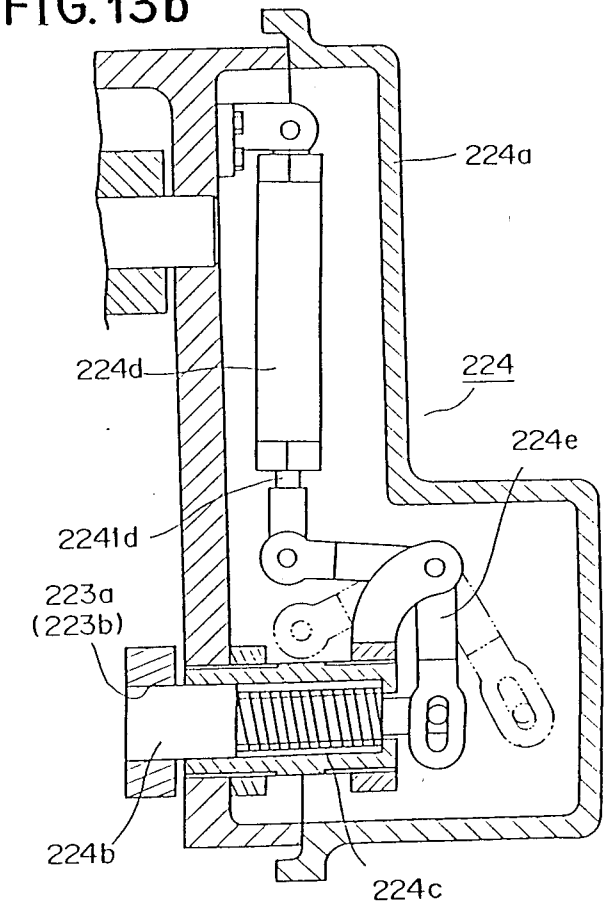
FIG. 13*b* is a sectional side elevation of the locking mechanism of FIG. 13*a;*
Figure 13A:
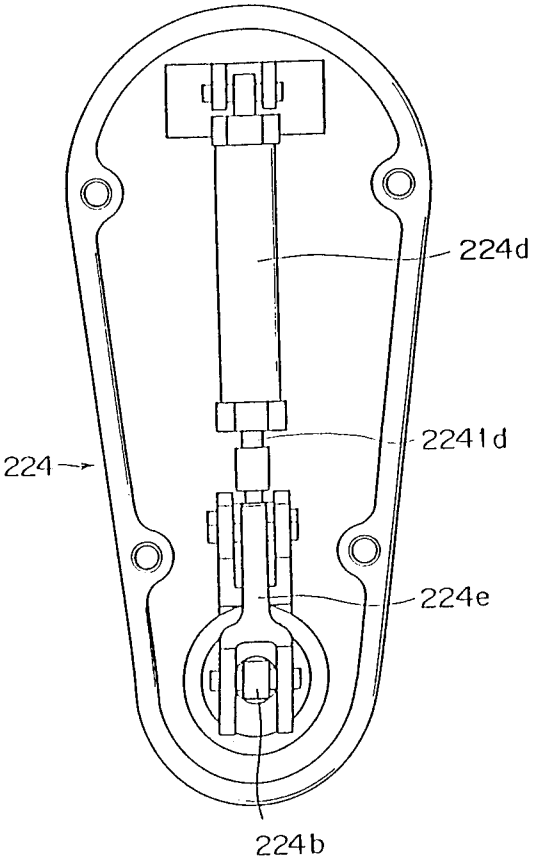
FIG. 13*a* is a front elevation of a locking mechanism of the second embodiment.

As illustrated in FIGS. 13*a* and 13*b*, the locking mechanism 224 comprises a casing 224*a* provided on the first arm 221, a locking pin 224*b* supported on the casing 224*a* so as to be inserted into a hole 223*a* or 223*b* (FIG. 8) formed in the second arm 223, a spring 224*c* biasing the locking pin 223*b* toward the second arm 223, a hydraulic cylinder 224*d* for moving the locking pin 224*b* against the resilience of the spring 224*c*, and an L-shaped lever 224*e* for interconnecting the piston rod 2241*d* of the hydraulic cylinder 224*d* and the locking pin 224*b*. In locking the second arm 223 to the first arm 221, the piston rod 2241*d* is retracted to allow the locking pin 224*b* to be projected by the resilience of the spring 224*c* so that the locking pin 224*b* is able to be inserted into the hole 223*a* or 223*b* of the second arm 223. In unlocking the second arm 223 from the first arm 221, the piston rod 2241*d* is projected to pull out the locking pin 224*b* forcibly from the hole 223*a* or 223*b* against the resilience of the spring 224*c*.

Figure 14A:
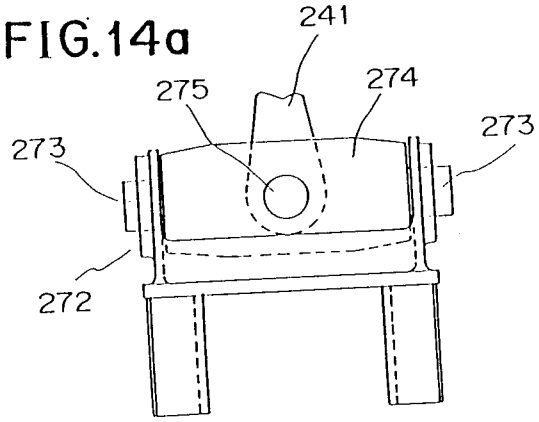
FIG. 14*a* is a front elevation of a yoke of the second embodiment.
Figure 14B:
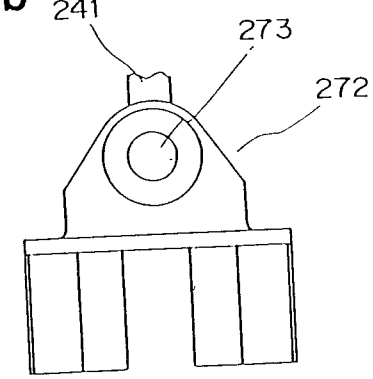
FIG. 14*b* is a side elevation of the yoke of FIG. 14*a;*

A yoke 272 is attached to the upper end of the main column 207. As illustrated in FIGS. 14*a* and 14*b*, a trunnion 274 is joined pivotally to the yoke 272 with pins 73. The rotary yoke 241 of the rotative driving mechanism 204 is detachably joined to the trunnion 274 with pins 275. The trunnion 274 allows the tilt of the lifting magnet unit when the weight of lifted articles is irregularly distributed on the lifting magnet unit.

Figure 15A:
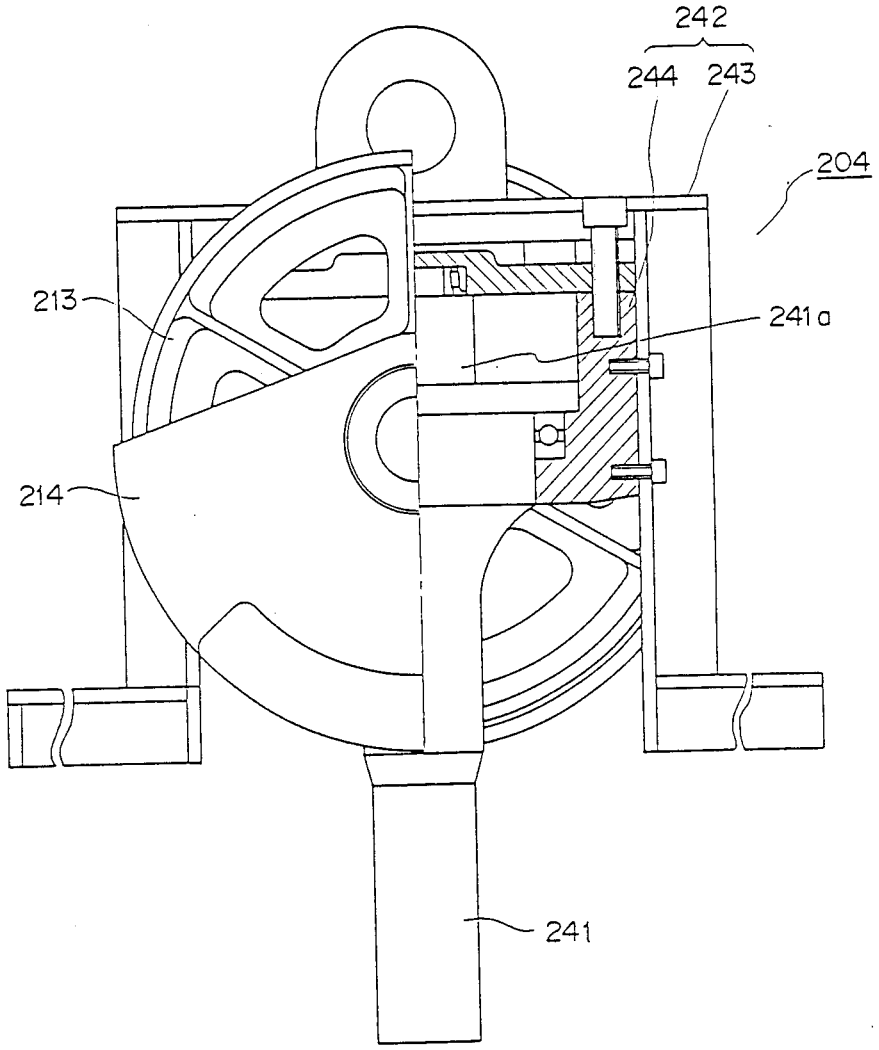
FIG. 15*a* is a partly cutaway front elevation of a rotative driving mechanism.
Figure 15B:
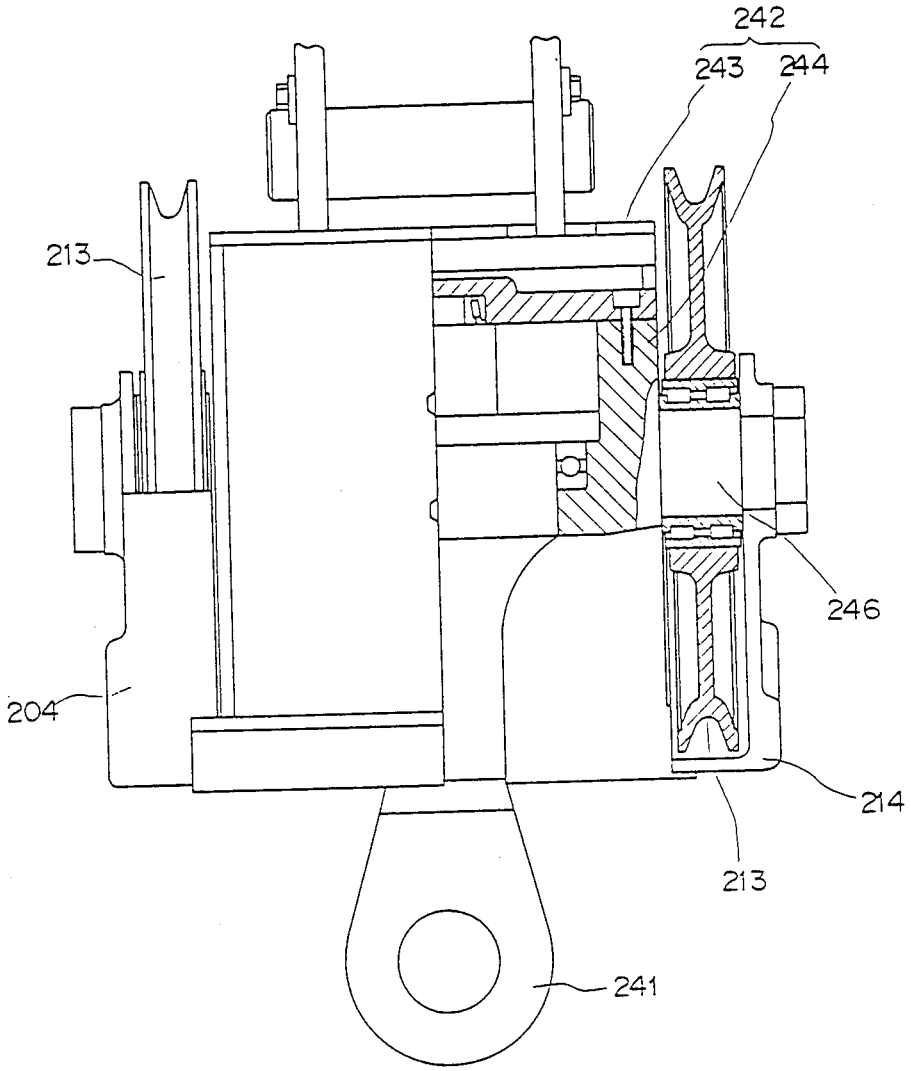
FIG. 15*b* is a partly cutaway side elevation of the rotative driving mechanism of FIG. 15*a;*
Figure 15C:
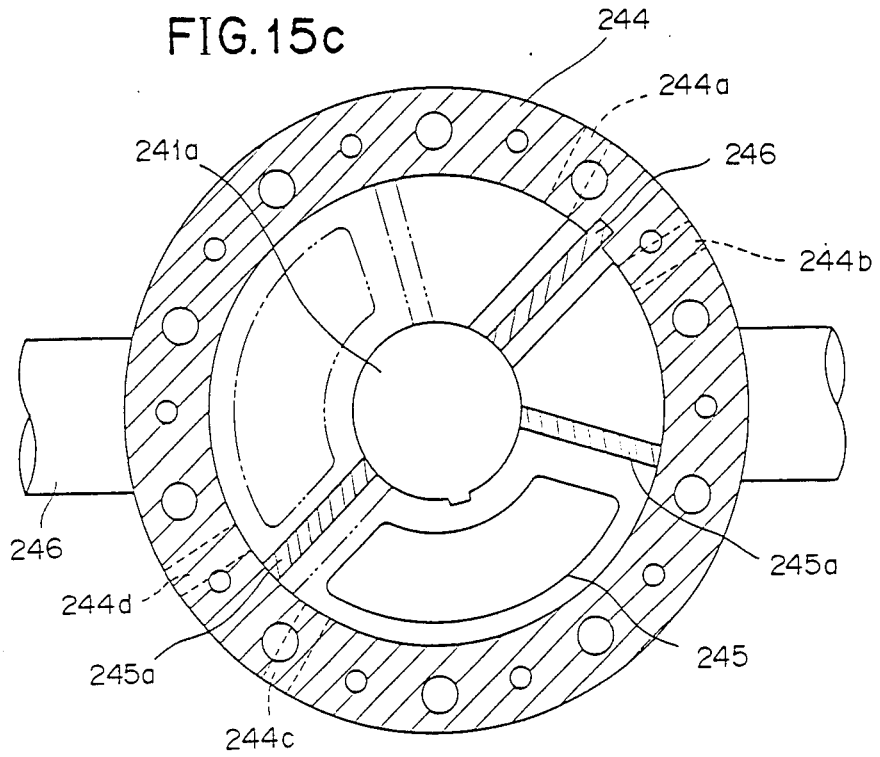
FIG. 15*c* is a plan view of the case member of the rotative driving mechanism of FIG. 15*a;*

As illustrated in FIGS. 15*a* and 15*b* the rotative driving mechanism 204 comprises the rotary yoke 241 and a hydraulic driving unit 242 for rotatively driving the rotary yoke 241. The hydraulic driving unit 242 has a valve base 243, a driving member 244 fixed to the valve base 243 and a set of valves, not shown, mounted on the driving member 244. A sectorial rotor 245 engaging the upper end 241*a* of the rotary yoke 241, and a partition plate 246 are provided within the driving member 244. Ports 244*a* and 244*b* and outlet ports 244*a* and 244*d* forpassing working fluid are formed in the peripheral wall of the driving member 244 (FIG. 15*c*). In turning the sectorial rotor (hence, the rotary yoke 241) to a position indicated by continuous lines in FIG. 15*c*, the working fluid is supplied through the port 244*a* into the driving member 244, while the working fluid is discharged through the outlet port 244*d* and the port 244*b* and through stop valves, not shown. In turning the sectorial rotor 245 to a position indicated by alternate long and two short dashes lines, the working fluid is supplied into the driving member 244 through the port 244*b*, while the working fluid is discharged through the outlet port 244*c* and the port 244*a* and through stop valves, not shown. Thus, the sectional rotor 245 (hence, the rotary yoke 241) is turned in the angular range of 120°. Sealing rubber plates 245*a* are attached to the opposite side surfaces of the sectorial rotor 245, respectively. Two opposite gudgeons 246 are provided on the peripheral wall of the driving member 244. The sheaves 213 and guard covers 214 for retaining wires 215 wound around the sheaves 213 to suspend the hydraulic driving mechanism 242 from the hook of a crane (FIG. 8) in the grooves of the sheaves 213 are mounted on the gudgeons 246, respectively.

The manner of operation of the lifting magnet unit with a gripping mechanism thus constituted will be described hereinafter.

(a) Use of only the lifting magnet 201:

The piston rods 2241*d* of the hydraulic cylinders 224*d* are projected to pull out the locking pins 224*b* from the holes 223*b* of the second arms 223, so that the second arms 223 are unlocked. Then, the main power cylinder 208 is actuated to raise the spider block 210 to the uppermost position and the piston rods 231 of the auxiliary power cylinders 203 are retracted. consequently, the first and second arms 221 and 223 are folded and the locking pins 224*b* slide along the second arms 223 as the first and second arms 221 and 223 are folded. Upon the coincidence of the locking pins 224*b* with the corresponding holes 223*a*, the locking pins 224*b* are inserted into the holes 223*a* by the resilience of the springs 224*c* to lock the second arms 223 to the corresponding first arms 221, respectively, in a folded position as indicated by alternate long and two short dashes lines in FIG. 8. In this state, the lifting magnet 201 is operated.

(b) Use of the lifting magnet 201 and the gripping arm assemblies 202:

In the state of (a), the piston rods 2241*d* of the hydraulic cylinders 224*d* are projected to pull out the locking pins 224*b* from the holes 223*a* to unlock the second arms 223 from the first arms 221, respectively. Then, the piston rods 231 of the auxiliary power cylinders 203 are projected to the maximum extent, and thereby the locking pins 224*b* slide along the second arms 223 as the first arms 221 are turned on the pins 206 and the second arms 203 turns on the pins 222 relative to the first arm 221. Upon the coincidence of the locking pins 224*b* with the holes 223*b* of the second arms 223, the locking pins 224*b* are inserted into the holes 223*b* by the resilience of the spring 224*c* to lock the second arms 223 to the first arms 221 in an operating position, respectively. In this state, the lifting magnet 201 is magnetized to attract and gather articles, and then the spider block 210 is lowered by the main power cylinder 208 to close the first and second arms 221 and 223 in a position indicated by continuous lines in FIG. 8, and thereby a large amount of articles is held by the lifting magnet 201 and the gripping arm assemblies 202. After demagnetizing the lifting magnet 201, the lifting magnet unit with a gripping mechanism is moved by the crane to transpart the articles to a predetermined place.

(c) Use of only the gripping arm assemblies 202:

Similarly to the procedure for (b), the spider block 210 is lowered by the main power cylinder 208 to close the gripping arm assemblies 202 so that a large amount of articles is held by the gripping arm assemblies 202, while the lifting magnet 201 remains unmagnetized.

(d) Use of only the hook:

The pins 275 are pulled off the trunnion 274 to remove the yoke 272 (hence, the lifting magnet 201 and the gripping arm assemblies 202) from the rotary yoke 241, and then the hook is joined to the rotary yoke 241 for lifting work by means of wires.

In the lifting operation in any one of the modes (a) to (d), the rotary yoke 241 can be turned in the angular range of 120° by the hydraulic driving mechanism 204.

A third embodiment of the present invention will be described hereinafter.

Figure 16:
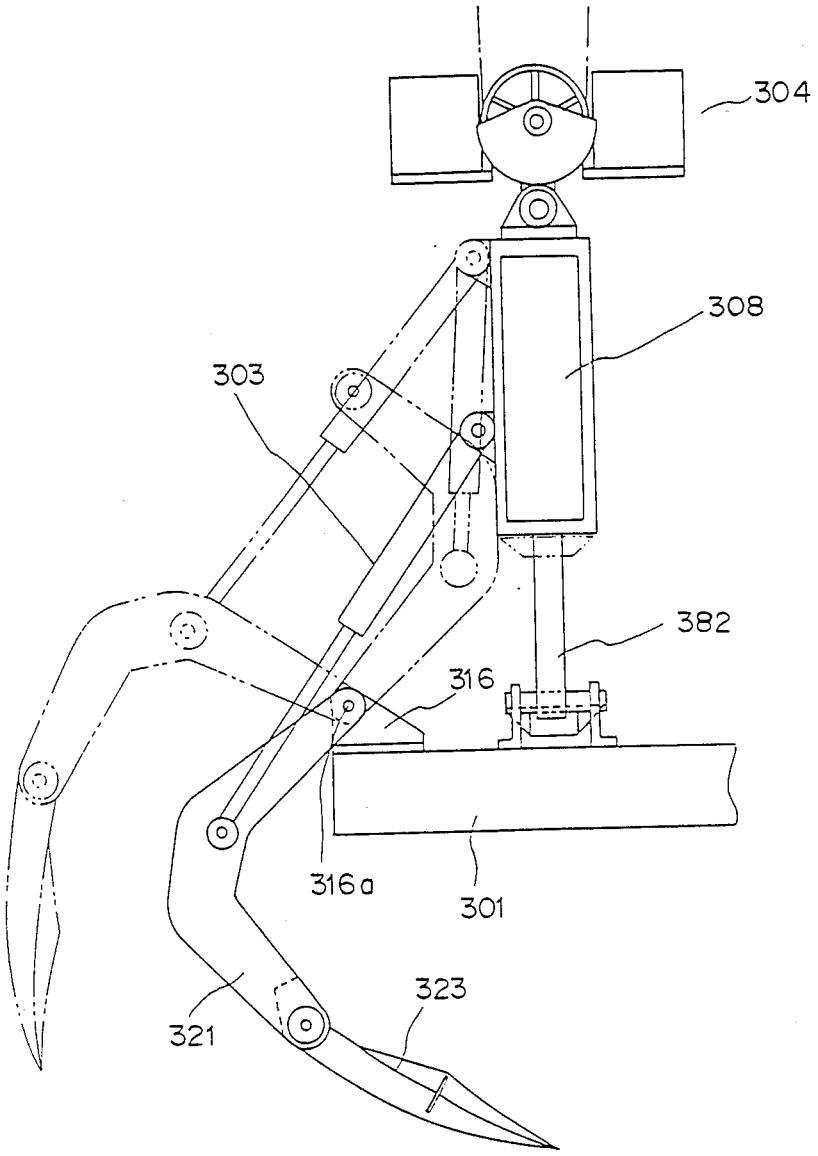
FIG. 16, is a fragmentary front elevation of a third embodiment of the present invention.

Referring to FIG. 16, a lifting magnet 301 is suspended from a main power cylinder 308. The third embodiment does not have any member corresponding to the main column 207 of the second embodiment. Triangular brackets 316 are fixed to the upper surface of the lifting magnet 301 and first arms 321 are joined pivotally to the triangular brackets 316 with pins 316*a*, respectively. The triangular brackets 316 may be attached to the circumference of the lifting magnet 301. Second arms 323 are joined pivotally to the first arms 321, respectively. The first and second arms 321 and 323 are closed for gripping when the piston rod 382 of the main power cylinder 308 is fully projected. Other components and constitution of the third embodiment are similar to those of the second embodiment.

Figure 17:
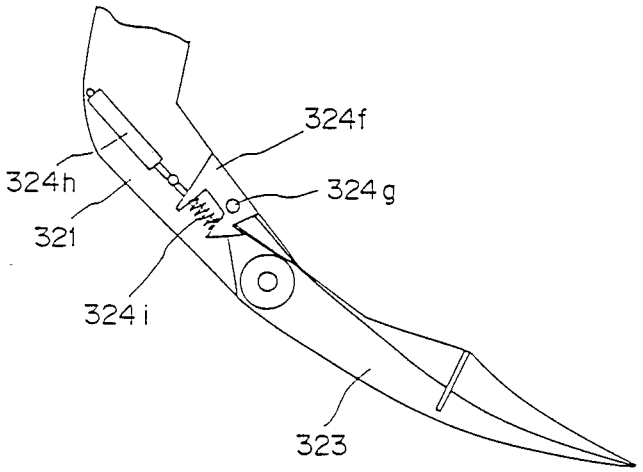
FIG. 17 is a schematic illustration of another locking mechanism according to the present invention.

FIG. 17 illustrates a modified form of the locking mechanism 224. The locking mechanism 224 comprises a locking plate 324*f* pivotally joined to the first arm 321 with a pin 324*g*, a hydraulic cylinder 324*h* for holding the locking plate 324*f* in a locking position, and an unlocking spring 324*i*. In locking the second arm 323 to the first arm 321, the locking plate 324*f* engages the second arm 323 and the piston rod of the hydraulic cylinder 324*h* is projected to hold the locking plate at the locking position.

Figure 18:
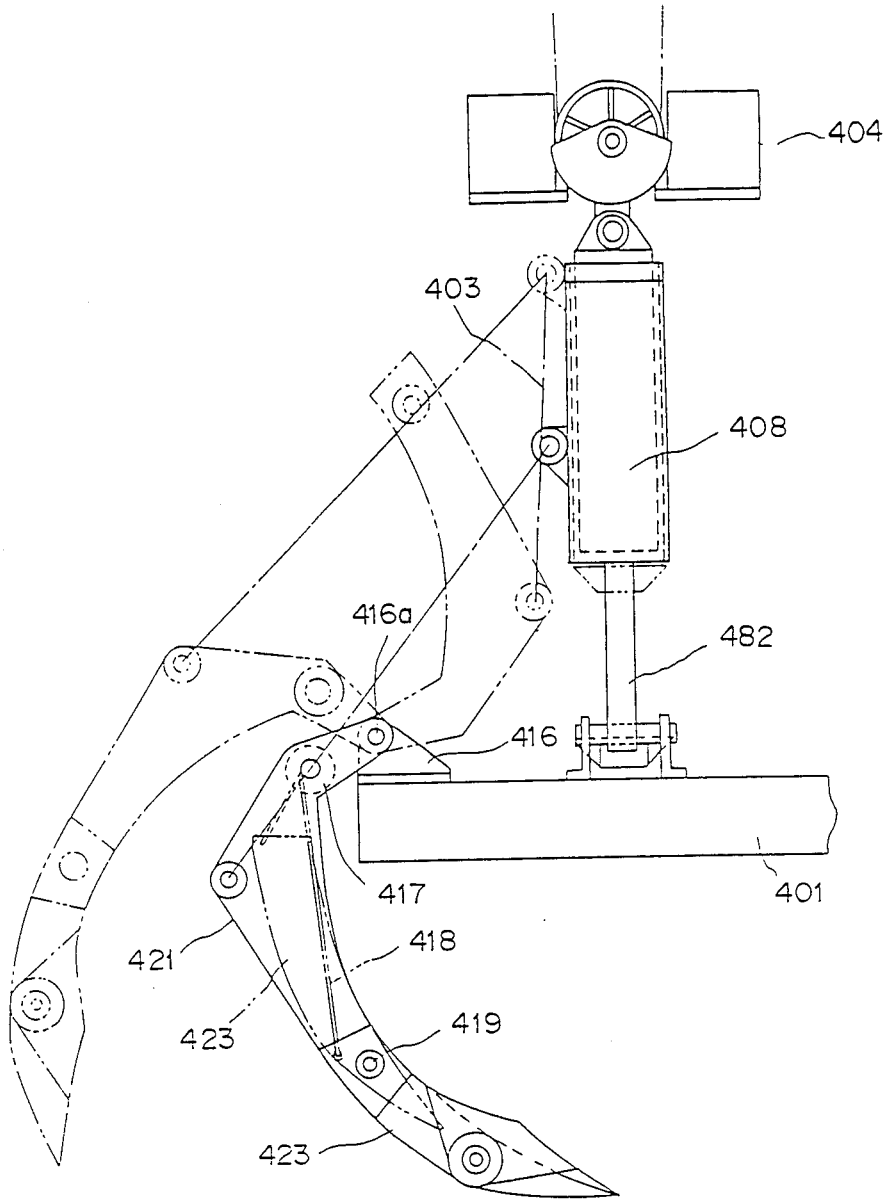
FIG. 18 is a fragmentary front elevation of a fourth embodiment of the present invention.

A fourth embodiment of the present invention is illustrated in FIG. 18. In the fourth embodiment, the second arms 423 can be retracted into the first arms 421 by means of hydraulic reduction motors 417 provided on the first arms 421, respectively. A double-row chain 418 is wound around a sprocket fixed to the output shaft of the hydraulic reduction motor 417 at one end and is connected to the second arm 423 at the other end. In retracting the second arm 423 into the first arm 421, the hydraulic reduction motor 417 is actuated to pull upon the second arm 423 with the double-row chain 418. When the second arm 423 is extended for use, the second arm 423 is locked to the first arm 421 with a locking pin 419.

The fourth embodiment may be provided with scope members. The scope member may be hinged to the free end of the second arm 423 so as to be folded on and fastened with bolts to the second arm 423 when the second arm 423 is not used and so as to be extended and locked to the second arm 423 with a locking pin. It is also possible to fit the scope member on and to lock the same with a locking pin to the second arm 423 after extending the second arm 423.

Similarly to the third embodiment, the fourth embodiment has a main power cylinder 408 and a lifting magnet 401 suspended from the main power cylinder 408, and does not have any member corresponding to the main column 207 of the second embodiment. The first and second arms 421 and 423 are closed for gripping when the piston rod of the main power cylinder 408 is fully extended. The first arms 421 are joined pivotally to triangular brackets 416 fixed to the upper surface or the circumference of the lifting magnet 401 with pins 416*a*.

Although the means employed in the second, third and fourth embodiments for operating the gripping arm assemblies are hydraulic cylinders, electric driving means may be employed instead of the hydraulic cylinders. The number of the gripping arm assemblies is not limited to four, but may be an optional number, as two or three.

A fifth embodiment of the present invention will be described hereinafter with reference to FIGS. 19 to 28.

The rear end of a main power cylinder 504 is joined pivotally with a pin 503 to a bracket 502 attached to the central portion of the upper surface of a lifting magnet 501 having an attracting surface 501*a*. A reduced part 505*a* having a threaded portion 505*b* is formed in the extremity of the piston rod 505 of the main power cylinder 504. A four-arm spider block 506 is fitted on the reduced part 505*a* of the piston rod 505 and is fastened thereto with a nut 507. The four-arm spider block 506 has four rectangular bifurcate arms 506*a*. One end of an auxiliary power cylinder 508 is joined pivotally to each bifurcate arm 506*a*. A rotary shaft 509*a* of a rotative driving mechanism 509 is joined pivotally to the upper portion of the four-arm spider block 506 with a pin 506*b*.

Figure 24:
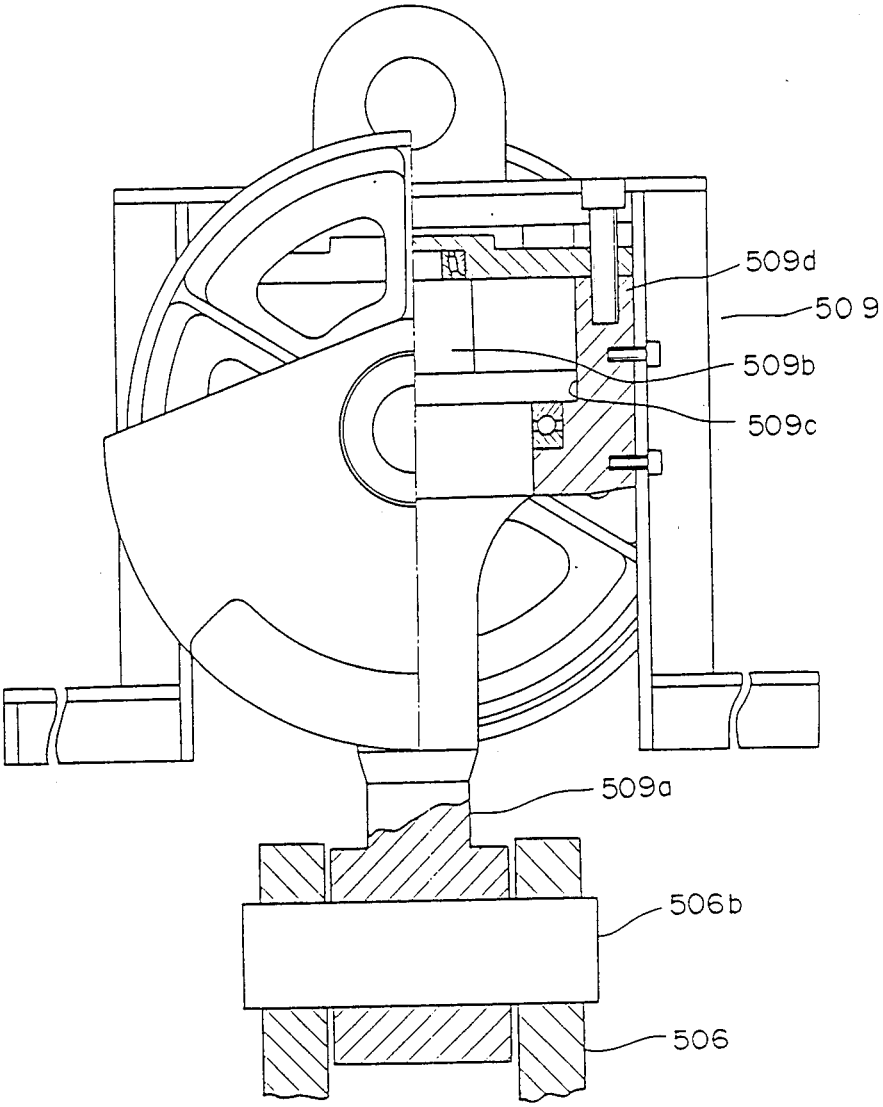
FIG. 24 is a front elevation of a rotative driving mechanism of the fifth embodment.
Figure 25:
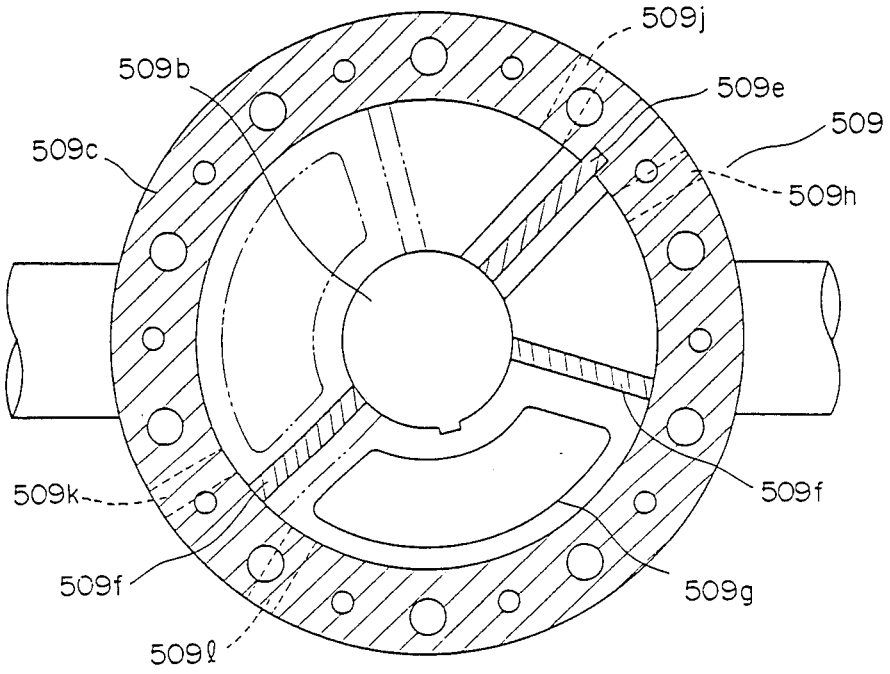
FIG. 25 is a sectional plan view of the rotative driving mechanism of FIG. 24.

As illustrated in FIGS. 24 and 25, the rotative driving mechanism 509 has a sealed cylinder 509*d* accommodating the upper end 509*b* of the rotary shaft 509*a* and a flange 509*c*, and a partition plate 509*e* partitioning a space defined by the inner circumference of the cylinder 509*d* and the outer circumference of the upper end 509*b* of the rotary shaft 509*a*. A sectoral rotor 509*g* provided with sealing members 509*f* closely contacting the inner circumference of the cylinder 509*d* on the opposite sides thereof is fixed to the upper end 509*b* of the rotary shaft 509*a*. Inlet ports 509*h* and 509*j* are formed in the peripheral wall of the cylinder 509*d* on the opposite sides of the partition plate 509e, respectively, near one end of the partition plate 509e, while outlet ports 509k and 509l are formed in the peripheral wall of the cylindeer 509d on the opposite sides of the partition plate 509e, respectively, near the other end of the partition plate 509e. When the working fluid is supplied through the inlet port 509h the cylinder 509d, the sectoral rotor 509g is turned from a position indicated by continuous lines to a position indicated by alternate long and two short dashes lines in FIG. 25, and thereby the four-arm spider block 506 is turned accordingly. When the working fluid is supplied through the inlet port 509j into the cylinder 509d, the rotary shaft 509a, hence, the four-arm spider block 506, is turned in the opposite direction.

Figure 19:
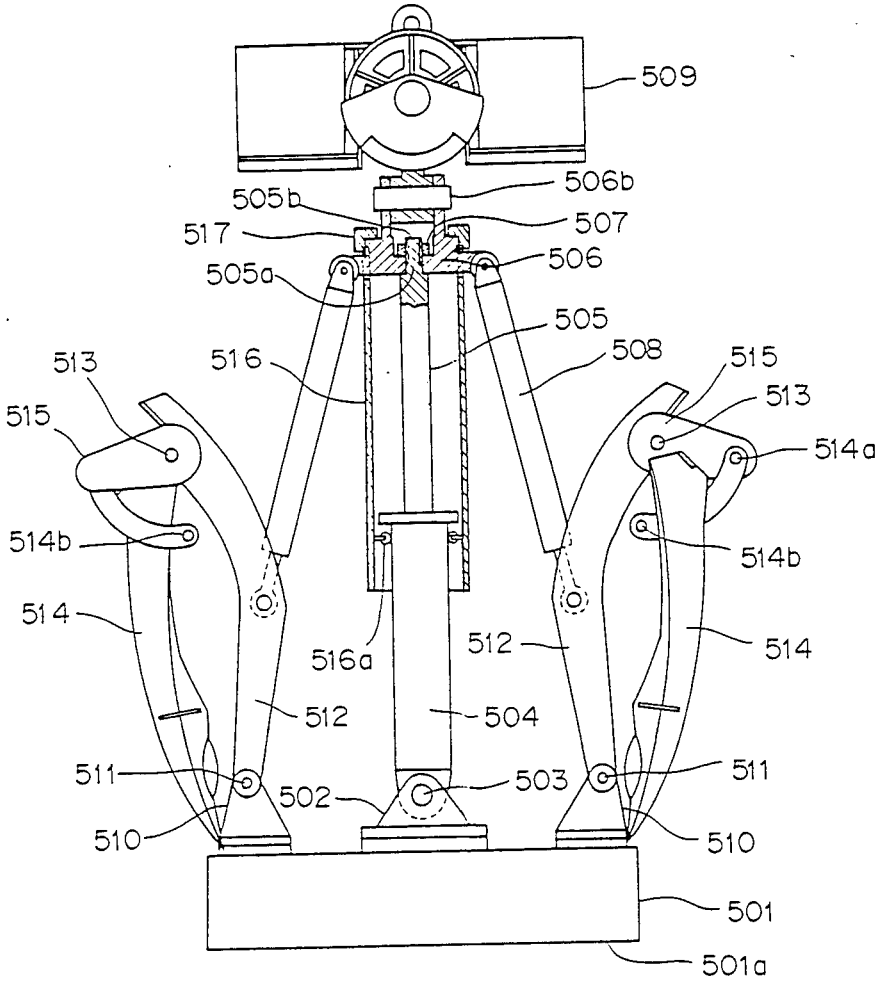
FIG. 19 is a front elevation of a fifth embodiment of the present invention, in which the piston rod of a main power cylinder unit is extended.
Figure 20:
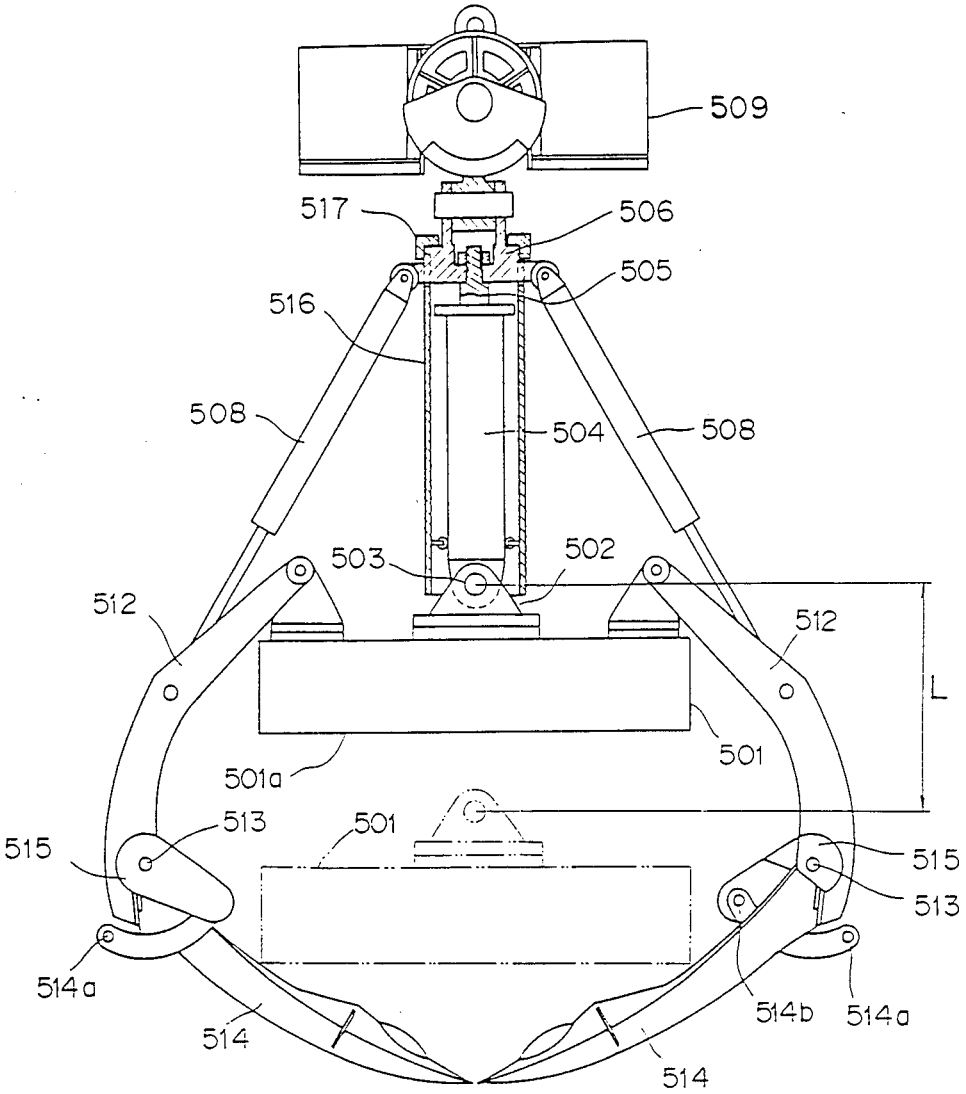
FIG. 20 is a front elevation of the fifth embodiment of FIG. 19, in which the piston rod of the main power cylinder unit is retracted.
Figure 21:
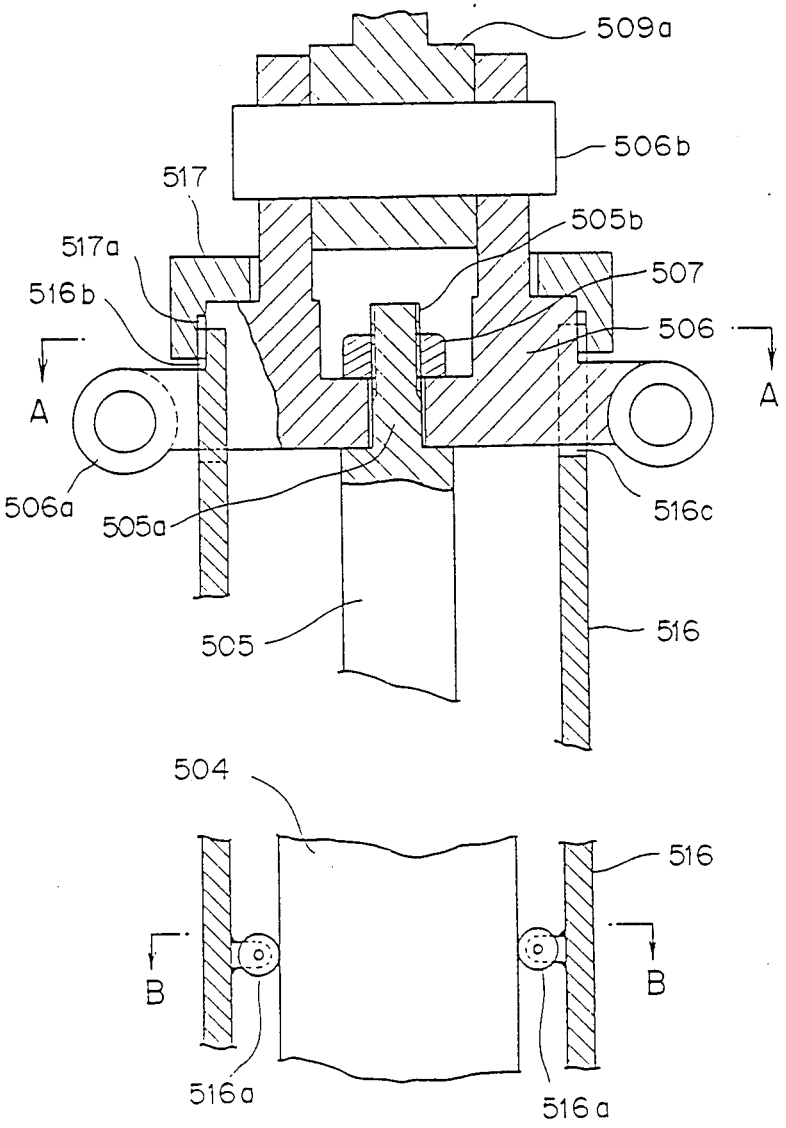
FIG. 21 is a fragmentary sectional view of the embodiment of FIG. 19.
Figure 22:
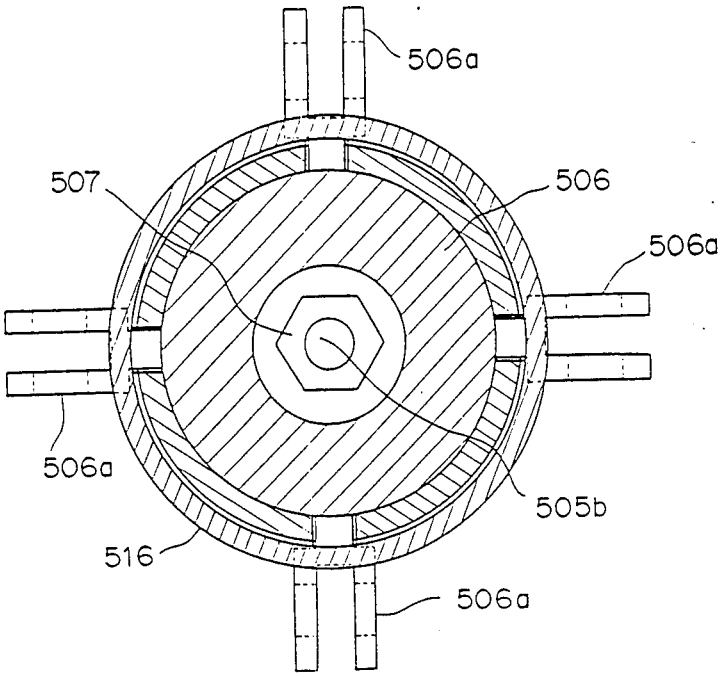
FIG. 22 and 23 are cross-sectional views taken on line A—A and on line B—B, respectively, in FIG. 21.
Figure 23:
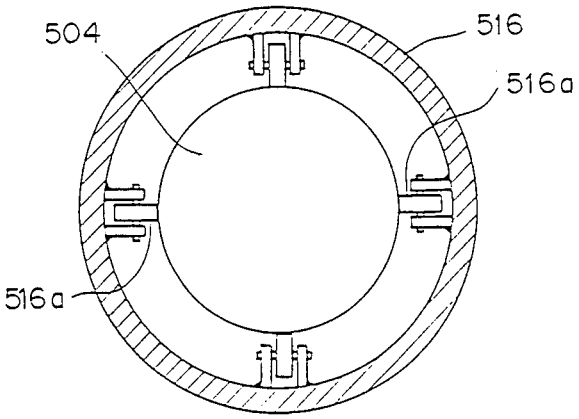

Referring to FIGS. 19 and 20, four brackets 510 are attached to the upper surface of the lifting magnet 501. Each one of first arms 512 is joined pivotally at one end to the bracket 510 with a pin 511. A second arm 514 is joined pivotally to the other end of the first arm 512 with a pin 513. The extremity of the piston rod of the auxiliary power cylinder 508 is joined pivotally to the middle portion of the upper arm 512.

Figure 27:
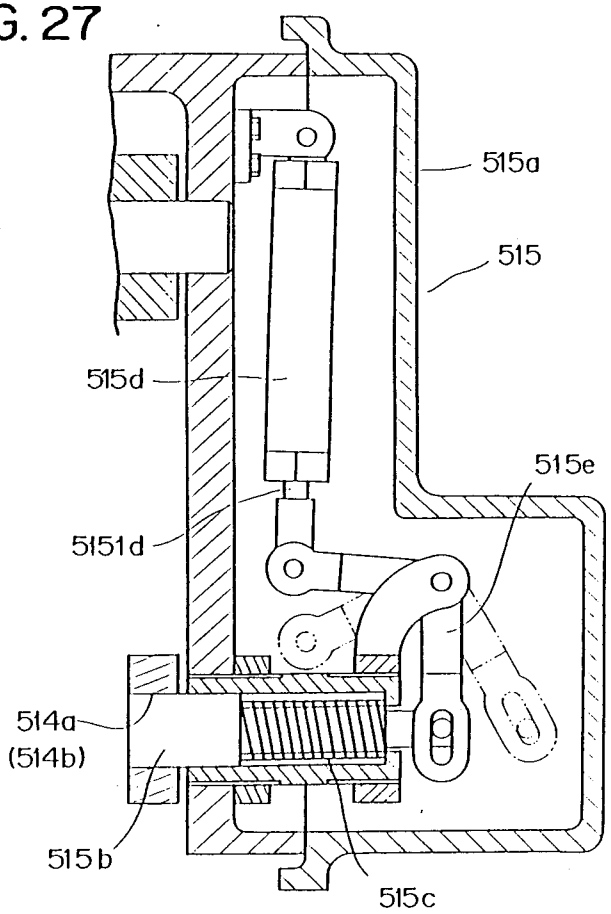
FIG. 27 is a longitudinal sectional view of the second arm locking mechanism of FIG. 26.
Figure 26:
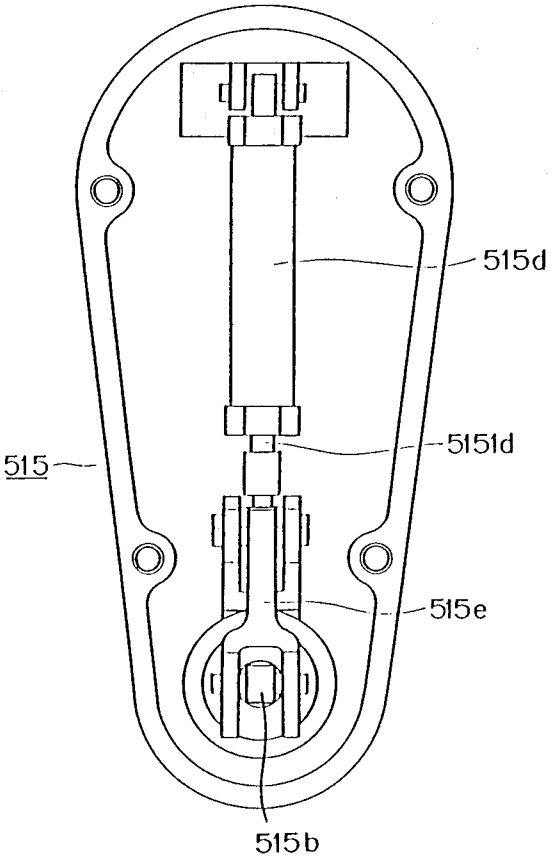
FIG. 26 is a front elevation of second arm locking mechanism.

As illustrated in FIGS. 26 and 27, a locking mechanism 515 provided on the first arm 512 comprises a cover 515a, a locking pin 515b capable of being inserted into a hole 514a, or 514b (FIG. 19) formed in the second arm 514, a spring 515c biasing the locking pin toward the second arm 514, a hydraulic cylinder 515d for moving the locking pin 515b against the resilience of the spring 515c, and an L-shaped lever 515e interconnecting the piston rod 5151d of the hydraulic cylinder 515d and the locking pin 515b. In locking the second arm 514 to the first arm 512, the piston rod 5151d is retracted to allow the locking pin 515b to be inserted into the hole 514a or 514b of the second arm 514 by the resilience of the spring 515c. In unlocking the second arm 514 the first arm 512, the piston rod 5151d is projected to pull out the locking pin 515b from the hole 514a or 514b against the resilience of the spring 515c.

As illustrated in FIGS. 19 to 23, a guide pipe 516 having guide rollers 516a is provided for guiding the vertical movement of the cylinder of the main power cylinder 504. An external thread 516b is formed in the upper end of the guide pipe 516. A guide pipe hanging member 517 having an internal thread 517a is fitted on the four-arm spider block 506. The guide pipe 516 is screwed on the guide pipe hanging member 517 so that the guide pipe 516 is hung on the guide pipe hanging member 517. Slots 516c are formed in the upper portion of the guide pipe 516 to prevent interference between the four-arm spider block 506 and the guide pipe 516.

Figure 28:
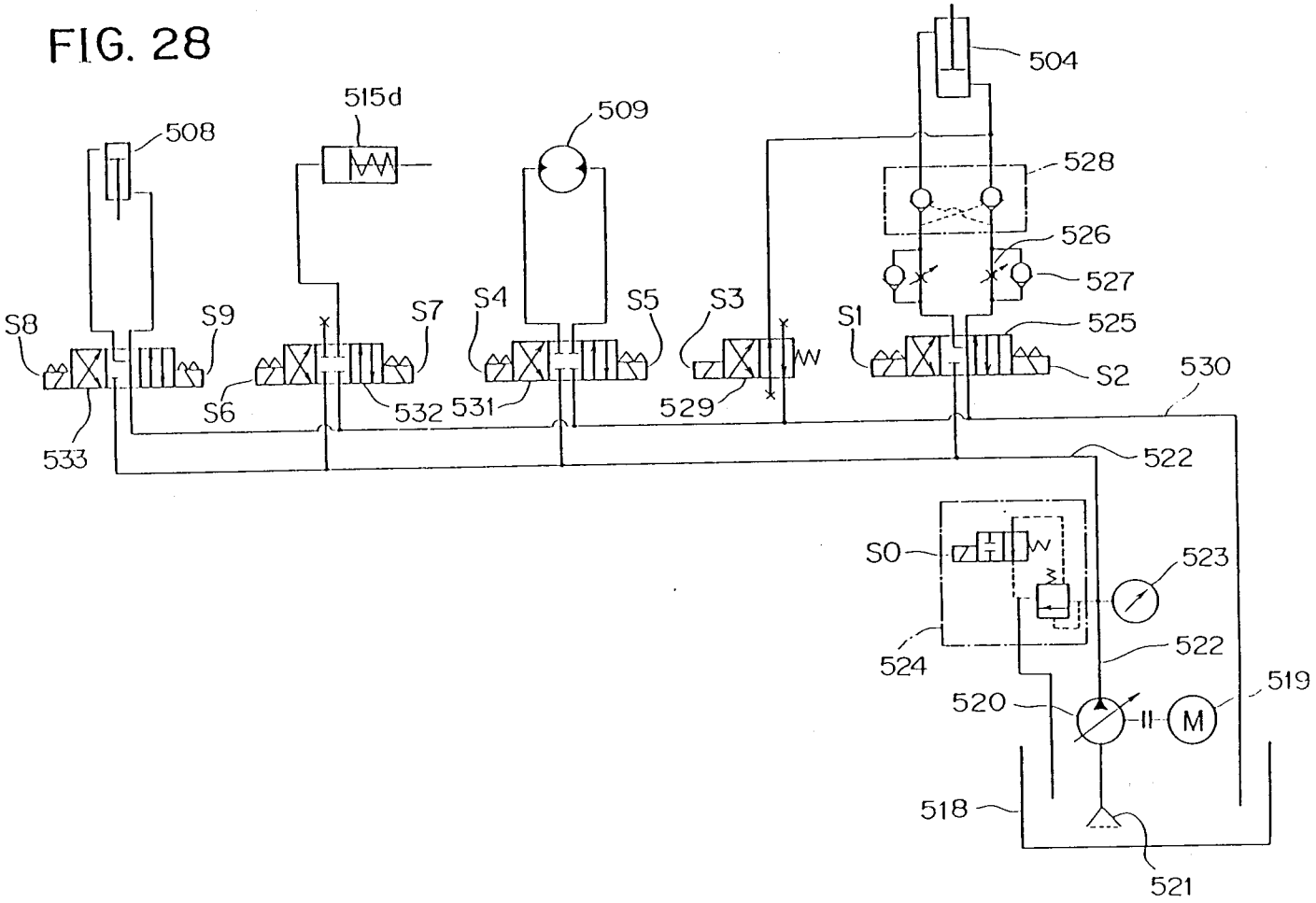
FIG. 28 is a diagram showing a hydraulic circuit employed in the fifth embodiment.

Referring to FIG. 28 showing a hydraulic circuit of a hydraulic unit for driving gripping arm assemblies of the present invention, the working fluid stored in a tank 518 is pumped up through a filter 521 and is delivered to a supply line 522 with a variable-capacity pump 520 driven by a motor 519. A pressure gauge 523 for indicating the pressure of the working fluid in the supply line 522 and an unloader 524 are provided in the supply line 522. The main power cylinder 504 is controlled by energizing the solenoid S1 or S2 of an electromagnetic valve 525. A branch circuit for controlling the main power cylinder 504 includes restrictors 526, check valves 527 and a pilot check valve 528. Since the return flow of the working fluid is restricted by the restrictors 526, the piston rod of the main hydraulic cylinder 504 is operated at a low speed. When the piston rod of the main power cylinder 504 is required to be retracted at a high speed, the solenoid S3 of an electromagnetic valve 529 and the solenoid S1 of the electromagnetic valve 525 are energized to make the working fluid flow through the electromagnetic valve 529 instead of through the restrictor 526 into a return line 530. The solenoid S4 or S5 of an electromagnetic valve 531 is energized to turn the rotary shaft 509a of the rotative driving mechanism 509 clockwise or counterclockwise. The solenoid S6 or S7 of an electromagnetic valve 532 is energized to control the hydraulic cylinders 515d of the locking mechanisms. The solenoid S8 or S9 of an electromagnetic valve 533 is energized to control the auxiliary power cylinders 508.

In a state where the first arms 512 and the second arms 514 are folded on the lifting magnet 501 as illustrated in FIG. 19, the piston rods 5151d of the hydraulic cylinders 515d are projected to pull out the locking pins 515b from the corresponding holes 514a to unlock the second arms 514 from the corresponding first arms 512. Then, the piston rods of the auxiliary power cylinders 508 are projected to turn the first arms 512 on the pins 510, respectively. Since the second arms 514 are always directed downward by their own dead weights, the second arms 514 open relative to the first arms 512 as the first arms 512 are opened. As the second arms 514 are opened relative to the first arms 512, the locking pins 515b slide along the side surface of the second arms 514 and, upon the coincidence of the locking pins 515b with the corresponding holes 514b of the second arms 514, the locking pins 515b are inserted into the holes 514b by the resilience of the springs 515c to lock the second arms 514 to the first arms 512, respectively. Then, the lifting magnet is magnetized to gather articles, and then the piston rod of the main power cylinder 504 is retracted to close the gripping arm assemblies in a state illustrated in FIG. 20 and to lift up the lifting magnet 501 from a position indicated by alternate long and two short dashes lines to a position indicated by continuous lines in FIG. 20. During this gripping operation, since the lifting magnet 501 is raised by a distance corresponding to the stroke L of the piston rod of the main power cylinder 504, the lifting magnet unit with a gripping mechanism is lowered by a distance L, and thereby the height of the lifting magnet unit with a gripping mechanism is reduced by a length L. The reduction of the height of the lifting magnet unit with a gripping mechanism is advantageous in operating the lifting magnet unit with a gripping mechanism in a place where only a narrow space for lifting operation is available, for example, in loading or unloading a truck having a large loading height by using an overhead traveling crane in a building having a low ceiling height. After closing the gripping arm assemblies as illustrated in FIG. 20, the lifting magnet unit with a gripping mechanism holding a large amount of articles is moved to a desired place by a crane.

A sixth embodiment of the present invention will be described hereinafter with reference to FIGS. 29 to 34 and 40 to 42.

Figure 29:
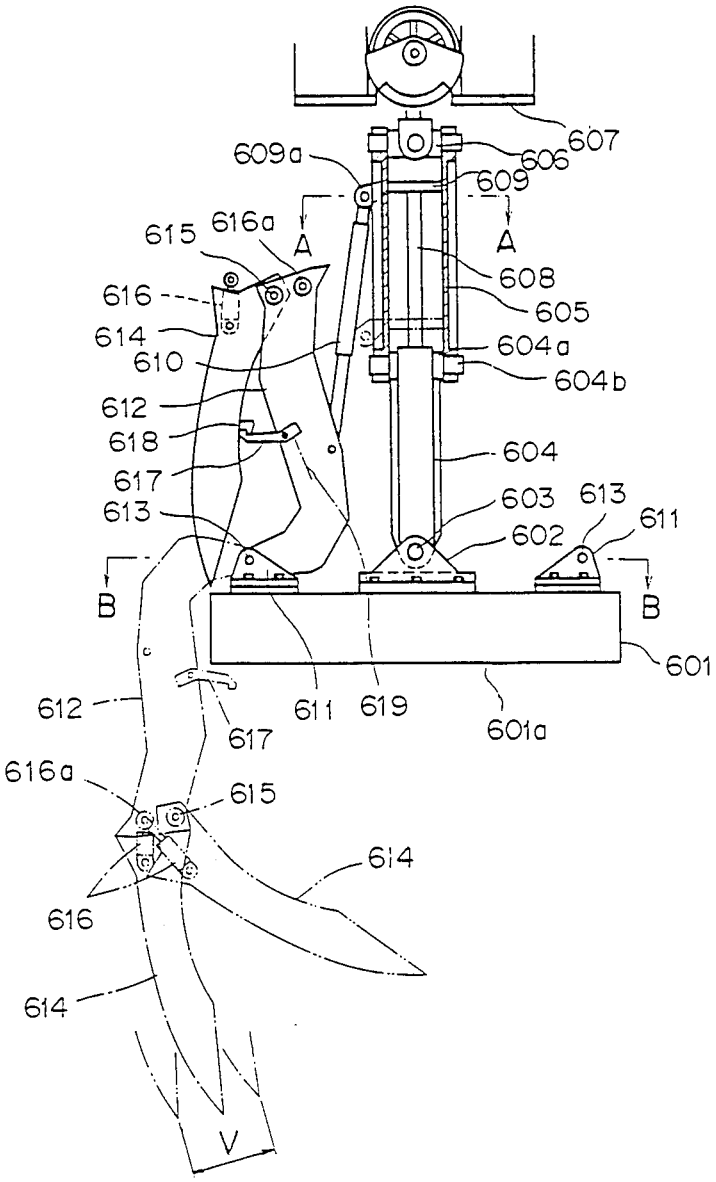
FIG. 29 is a general front elevation of a sixth embodiment of the present invention.

Referring to FIG. 29, a lifting magnet 1 has an attracting surface 601a for attracting magnetic articles. The lower end of a main power cylinder 604 is joined pivotally with a pin 603 to a bracket 602 attached to the central portion of the upper surface of the lifting magnet 601 opposite the attracting surface 601a. A pair of pins 604b diametrically projecting from bosses 604a formed in the upper end of the main power cylinder 604 are joined pivotally to the lower ends of a pair of supporting members 605, respectively. Accordingly, the lifting magnet 601 is able to turn on the pins 604*b* having an axis extending horizontally in parallel to the sheet and the pin 603 having an axis extending horizontally perpendicular to the sheet. That is, the lifting magnet 601 has two degrees of freedom of tilting motion, and hence the lifting magnet 601 is able to attract an article having an inclined upper surface closely.

The upper end of the supporting members 605 are joined pivotally to a trunnion 606, which is joined pivotally to a rotative driving mechanism 607 capable of turning in a horizontal plane.

Figure 32:
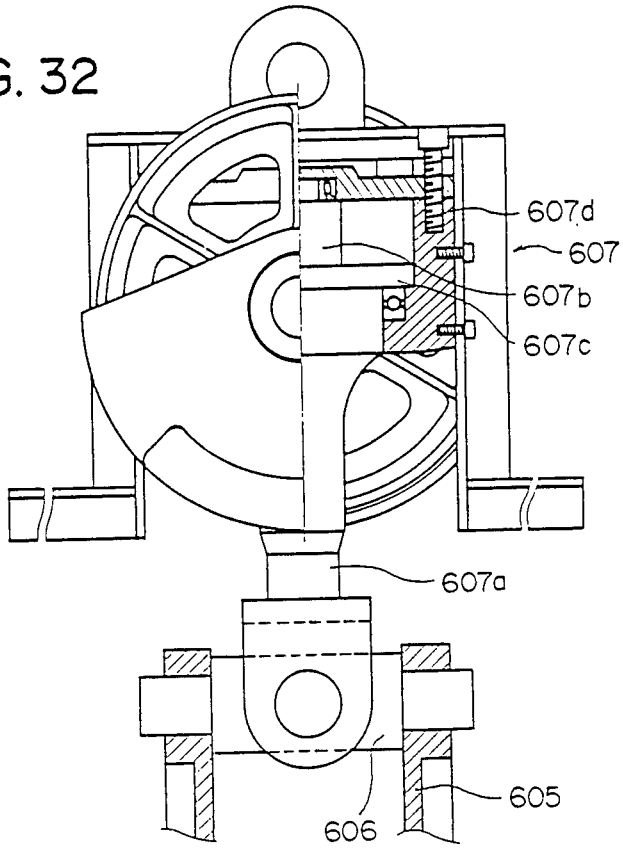
FIG. 32 is a front elevation of a rotative driving mechanism employed in the sixth embodiment.
Figure 33:
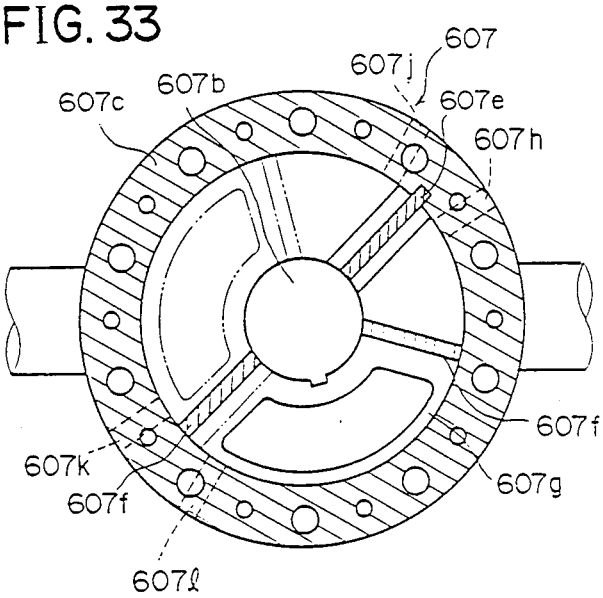
FIG. 33 is a sectional plan view of the rotative driving mechanism of FIG. 32.

As illustrated in FIGS. 32 and 33, the rotative driving mechanism 607 comprises a rotary shaft 607*a* having an upper end 607*b* and a flange 607*c*, a sealed cylinder 607*d* accommodating the upper end 607*b* and the flange 607*c* of the rotary shaft 607*a*, a partition plate 607*e* partitioning a space defined by the inner circumference of the cylinder 607*d* and the outer circumference of the upper end 607*b* of the rotary shaft 607*a*, a sectoral rotor 607*g* fixed to the upper end 607*b* of the rotary shaft 607*a*, and sealing members 607*f* attached to the opposite sides of the sectoral rotor 607*g* so as to be in close contact with the inner circumference of the cylinder 607*d*. Inlet ports 607*h* and 607*j* are formed in the peripheral wall of the cylinder 607*d* on the opposite sides of one end of the partition plate 607*e*, while outlet ports 607*k* and 607*l* are formed in the peripheral wall of the cylinder 607*d* on the opposite sides of the other end of the partition plate 607*e*. When the working fluid is supplied through the inlet port 607*h* into the cylinder 607*d*, the sectoral rotor 607*g* can be moved from a position indicated by continuous lines to a position indicated by alternate long and two short dashes lines in FIG. 33. When the sectoral rotor 607*g* is turned, the trunnion 606 is turned by the rotary shaft 607*a*. When the working fluid is supplied through the inlet port 607*j* into the cylinder 607*d*, the trunnion 606 is turned by the rotary shaft 607*a* in the opposite direction.

Figure 31:
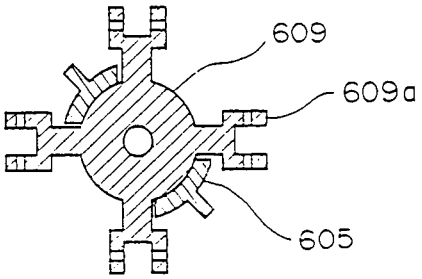
FIG. 31 is a sectional view taken on line A—A in FIG. 29.

As illustrated in FIG. 31, a spider block 609 having radial bifurcate arms 609*a* extending perpendicularly to each other is attached to the upper end of the piston rod 608 of the main power cylinder 604. One end of an auxiliary power cylinder 610 is joined pivotally to each bifurcate arm 609*a*.

Figure 30:
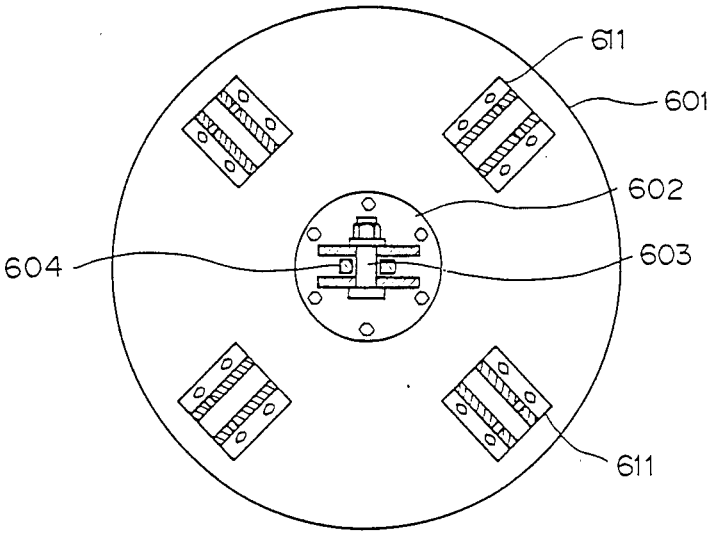
FIG. 30 is a sectional view taken on line B—B in FIG. 29.
Figure 40:
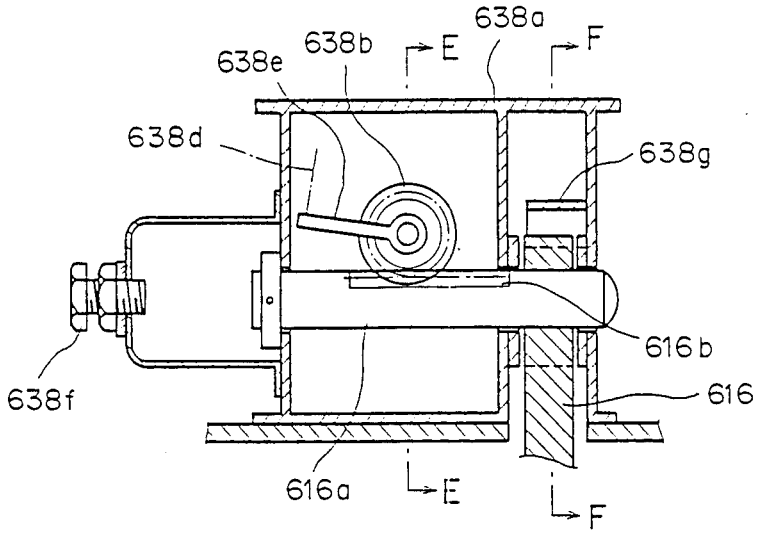
FIG. 40 is a sectional view of a pin control mechanism.
Figure 41:
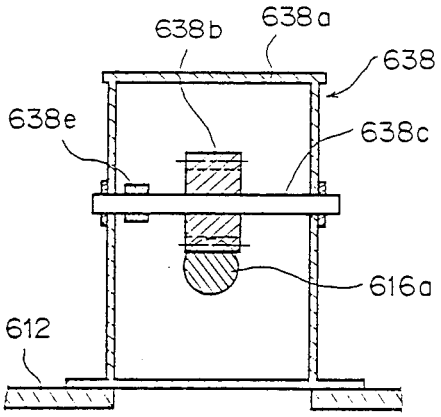
FIGS. 41 and 42 are sectional views taken on line E—E and on line F—F, respectively, in FIG. 40.
Figure 42:
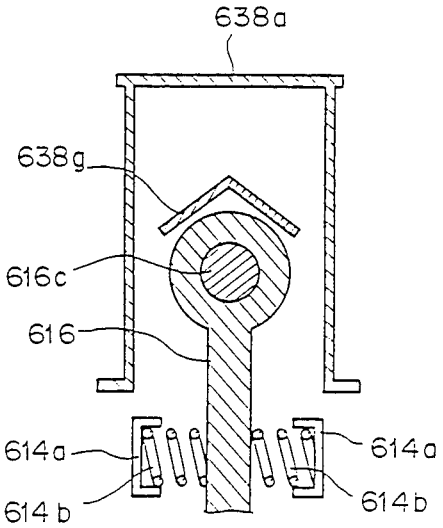

As illustrated in FIG. 30, four brackets 611 are attached to the upper surface of the lifting magnet 601. Each one of four first arms 612 is joined pivotally at one end thereof to the bracket 611. A second arm 614 is joined pivotally to the other end of the first arm 612 with a pin 615. A hydraulic cylinder 616 for operating the second arm 614 is joined detachably and pivotally to the other end of the first arm 612 with a pin 616*a* (FIG. 40). As illustrated in FIGS. 40 and 41, the pin 616*a* has a rack 616*b* and is axially movably supported on the casing 638*a* of a pin control mechanism 638. A pinion 638*b* fixed to a rotary shaft 638*c* rotatably supported on the casing 638*a* engages the rack 616*b*. A lever 638*e* is fixed to the rotary shaft 638*c*. A wire 638*d* (Cablex Push-Pull Cable®) which is pulled and pushed by a small hydraulic cylinder, not shown, is connected to the lever 638*e* to turn the lever 638*e* in opposite directions. The pin 616*a* is moved axially in opposite directions by the pinion 638*b* which is turned in opposite directions by the lever 638*e*. On end of the pin 616*a* is rounded so that the pin 616*a* can be easily received in the hole 616*c* of the hydraulic cylinder 616. An adjustable stopper 638*f* for adjusting the leftward stroke of the pin 616*a* and for limiting the leftward movement of the pin 616*a* is provided on the casing 638*a*. A V-shaped centering member 638*g* is provided on the inner surface of the side wall of the casing 638*a* to correct the position of the hydraulic cylinder 616 so that the pin 616*a* can be inserted smoothly into the hole 616*c* of the hydraulic cylinder 616. The hydraulic cylinder 616 is held in an approximately correct position by springs 614*b* held by spring holders 614*a* provided on the second arm 614. When the second arm 614 is folded, the pin 616*a* is moved leftward as viewed in FIG. 40 and is separated from the hole 616*c* of the hydraulic cylinder 616 by pulling the wire 638*d* to turn the pinion 638*b* engaging the rack 616*b* clockwise through the lever 638*e*. When the second arm 614 depends from the first arm 612 as indicated by alternate long and short dash lines in FIG. 29 for gripping articles, the pin 616*a* is moved to a position as shown in FIG. 40 and is inserted into the hole 616*c* of the hydraulic cylinder 616 by turning the pinion 638*b* counterclockwise through the lever 638*e*. After inserting the pin 616*a* into the hole 616*c* of the hydraulic cylinder 616, the piston rod of the hydraulic cylinder 616 is projected to turn the second arm 614 on the pin 615 for gripping action.

The first arm 612 is turned on the pin 613 by the main power cylinder 604 and the auxiliary power cylinder 610. A locking lever 617 pivotally joined to the first arm 612 engages a hook member 618 provided on the second arm 614, when the first arm 612 and the second arm 614 are folded on the lifting magnet 601 as indicated by continuous lines in FIG. 29 to fasten the second arm 614, to the first arm 612. The locking lever 617 is disengaged from the hook member 618 by pulling a wire 619 connected at one end to the locking lever 617 by a small hydraulic cylinder, not shown.

Figure 34:
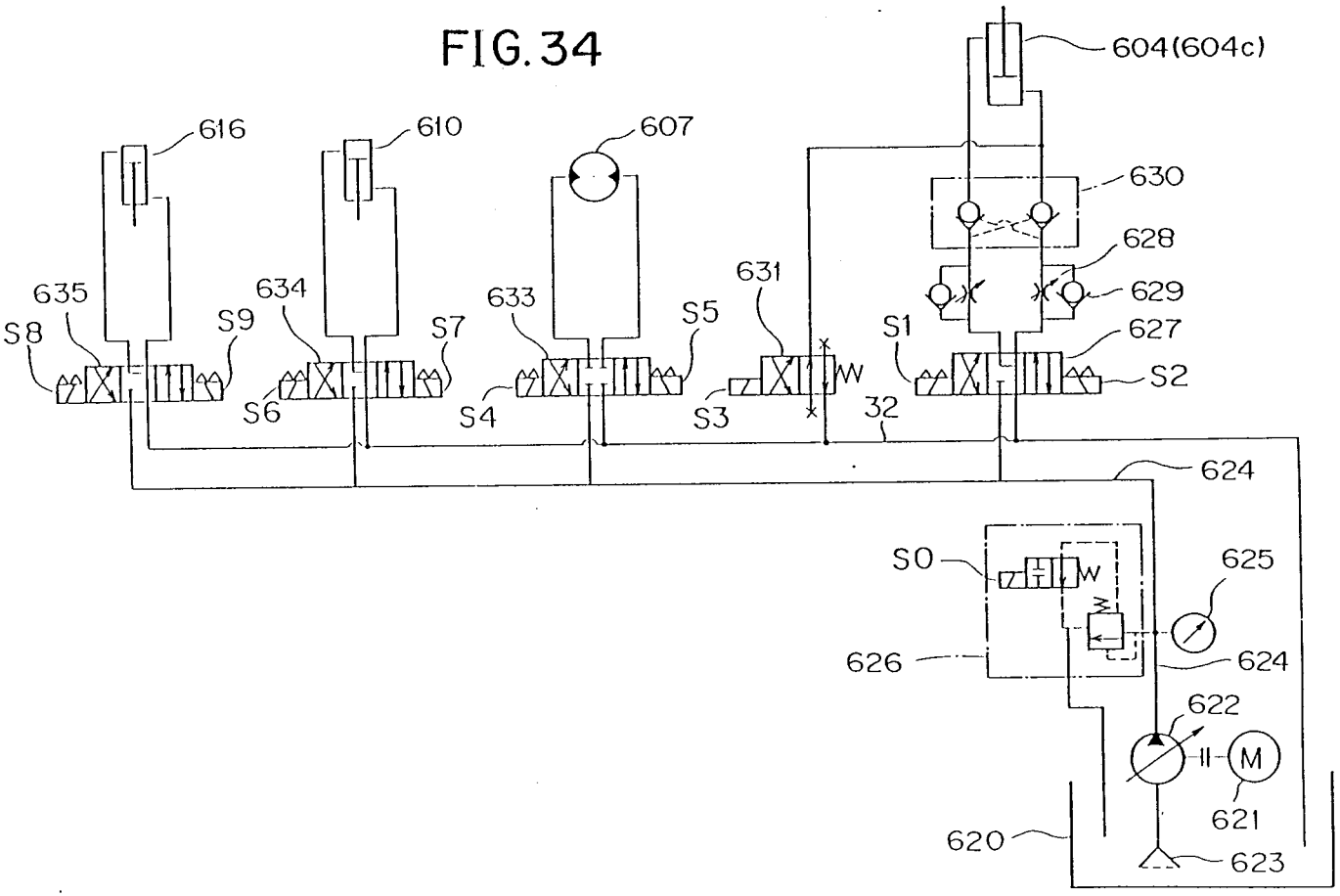
FIG. 34 is a diagram showing a hydraulic circuit employed in the sixth embodiment.
Figure 35:
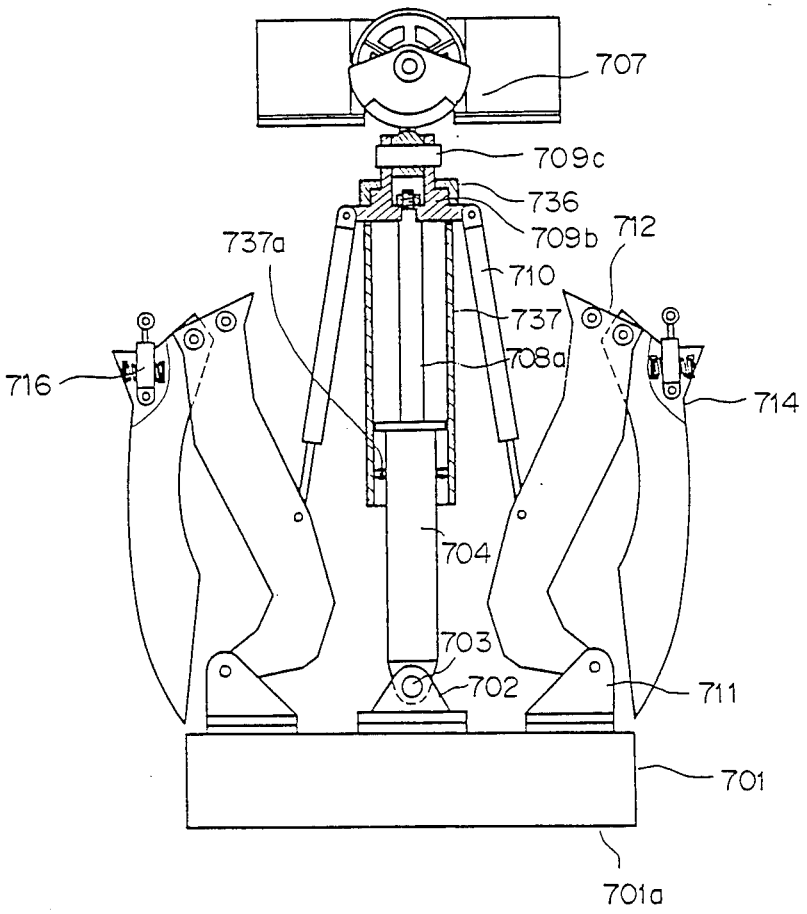
FIGS. 35 and 36 are front elevations of a seventh embodiment with the first and second arms retracted and extended, respectively.

Referring to FIG. 34 showing the hydraulic circuit of a hydraulic unit for controlling the gripping arm assemblies of the present invention, the working fluid is pumped up from a tank 620 through a filter 623 and is delivered to a supply line 624 by a variable-capacity pump 622 driven by a motor 621. A pressure gauge 625 for indicating the pressure of the working fluid in the supply line 624 and an unloader 626 are provided in the supply line 624. A branch circuit for controlling the main power cylinder 604 includes restrictors 628, check valves 629 and a pilot check valve 630. Since the return flow of the working fluid is restricted by the restrictors 628, the piston rod of the main power cylinder 604 is operated at a low speed. When the piston rod of the main power cylinder 604 is required to be retracted at a high speed, the solenoid S3 of an electromagnetic valve 631 and the solenoid S1 of an electromagnetic valve 627 are energized to make the working fluid flow through an electromagnetic valve 631 instead of through the restrictor 628 into a return line 632. The solenoid S4 or S7 of an electromagnetic valve 633 is energized to turn the rotary shaft 607*a* of the rotative driving mechanism 607 clockwise or counterclockwise. The solenoid S6 or S7 of an electromagnetic valve 634 is energized to project or to retract the piston rods of the auxiliary power cylinders 610. The solenoid S8 or S9 of an electromagnetic valve 635 is energized to project or to retract the piston rods of the hydraulic cylinders 616 for controlling the second arms 614.

In operation, the main power cylinder 604 and the auxiliary power cylinders 610 are actuated to unfold and to turn the first arms 612 and the second arms 614 to a position indicated by alternate long and shortdash lines. Then, the levers 638e are turned counterclockwise by the wires 638d to insert the pin 616a into the respective holes 616c of the hydraulic cylinders 616 so that the second arms 614 can be turned on the pins 615 relative to the first arms 612, respectively. Then, the gripping arm assemblies are lowered by the crane to thrust the second arms 614 into articles. Then, the solenoids S1 and S2 of the electromagnetic valve 627 are energized alternately under the control of suitable means, as a timer, to oscillate the second arms 614 in the range V of reciprocation of the free ends of the second arms 614 of about 200 mm (FIG. 29) so that the second arms 614 are thrusted deep into the mass of articles. Then, the piston rods of the hydraulic cylinders 616 are projected to turn the second arms 614 to a position indicated by alternate long and two short dashed lines to hold articles between the lifting magnet 601 and the second arms 614. Then, the lifting magnet unit with a gripping mechanism is raised and moved by the crane to transport the articles to a desired place.

A seventh embodiment of the present invention will be described hereinafter with reference to FIGS. 35 to 39.

Figure 37:
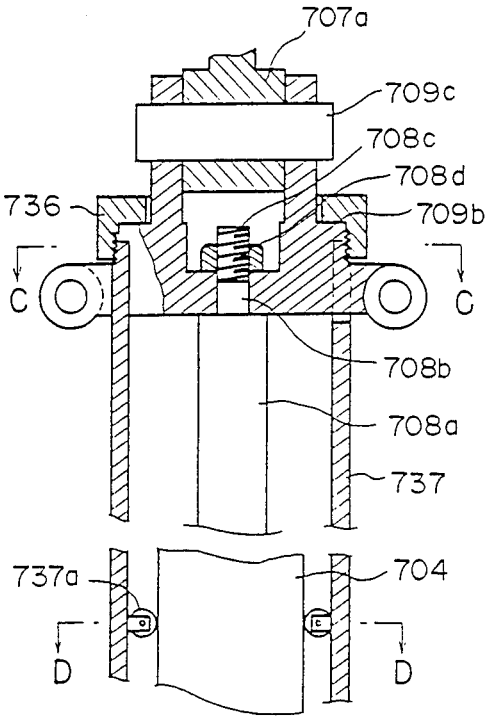
FIG. 37 is a fragmentary sectional front elevation of the seventh embodiment.
Figure 39:
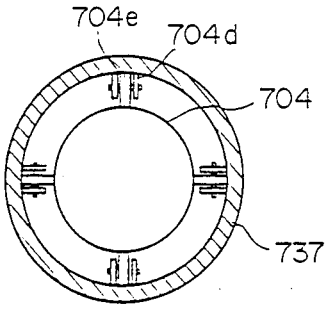
FIG. 39 is a sectional view taken on line D—D in FIG. 37.

The lower end of a main power cylinder 704 is joined pivotally with a pin 703 to a bracket 702 attached to the central portion of the upper surface of a lifting magnet 701 opposite the attracting surface 701a of the same. As illustrated in FIG. 37, a reduced part 708b having a threaded portion 708c is formed in the extremity of the piston rod 708a of the main lower cylinder 704. A four arm spider block 709b having four bifurcate arms 709a extending radially outward and perpendicularly to each other is fastened to the reduced part 708b with a nut 708d. One end of each of auxiliary power cylinders 710 is joined pivotally to the bifurcate arm 709a. The upper end of the spider block 709b is joined pivotally with a pin 709c to the rotary shaft 707a of a rotative driving mechanism 707. The constitution of the rotative driving mechanism 707 is the same as that of the rotative driving mechanism of the sixth embodiment. A guide pipe supporting member 736 having an internal thread 736a is mounted on the spider block 709b. A guide pipe 737 having an external thread 737a formed in the outer circumference of the upper end thereof and rotatably supporting guide rollers 737a is screwed on the guide pipe guiding member 736. Thus, the guide pipe 737 is suspended from the guide pipe supporting member 736.

The respective constitutions of the first arm 712 pivotally joined to four brackets 711 attached to the upper surface of the lifting magnet 701, and second arms 714 pivotally joined to the first arms, respectively, are the same as those of the sixth embodiment.

The constitution of the hydraulic unit is also the same as that of the hydraulic unit employed in the sixth embodiment.

The mode of operation of the seventh embodiment is different from that of the sixth embodiment in that the lifting magnet 701 moves upward by a distance L when the piston rod of the main power cylinder 704 is retracted by a distance L. Therefore, when the piston rod of the main power cylinder 704 is retracted by a distance, the lifting magnet unit with a gripping mechanism needs to be lowered by the same distance to maintain the level of the attracting surface 701a of the lifting magnet 701. Accordingly, the operating height of the seventh embodiment is reduced and hence the seventh embodiment can be advantageously operated at a place where only a narrow lifting space is available.

Figure 36:
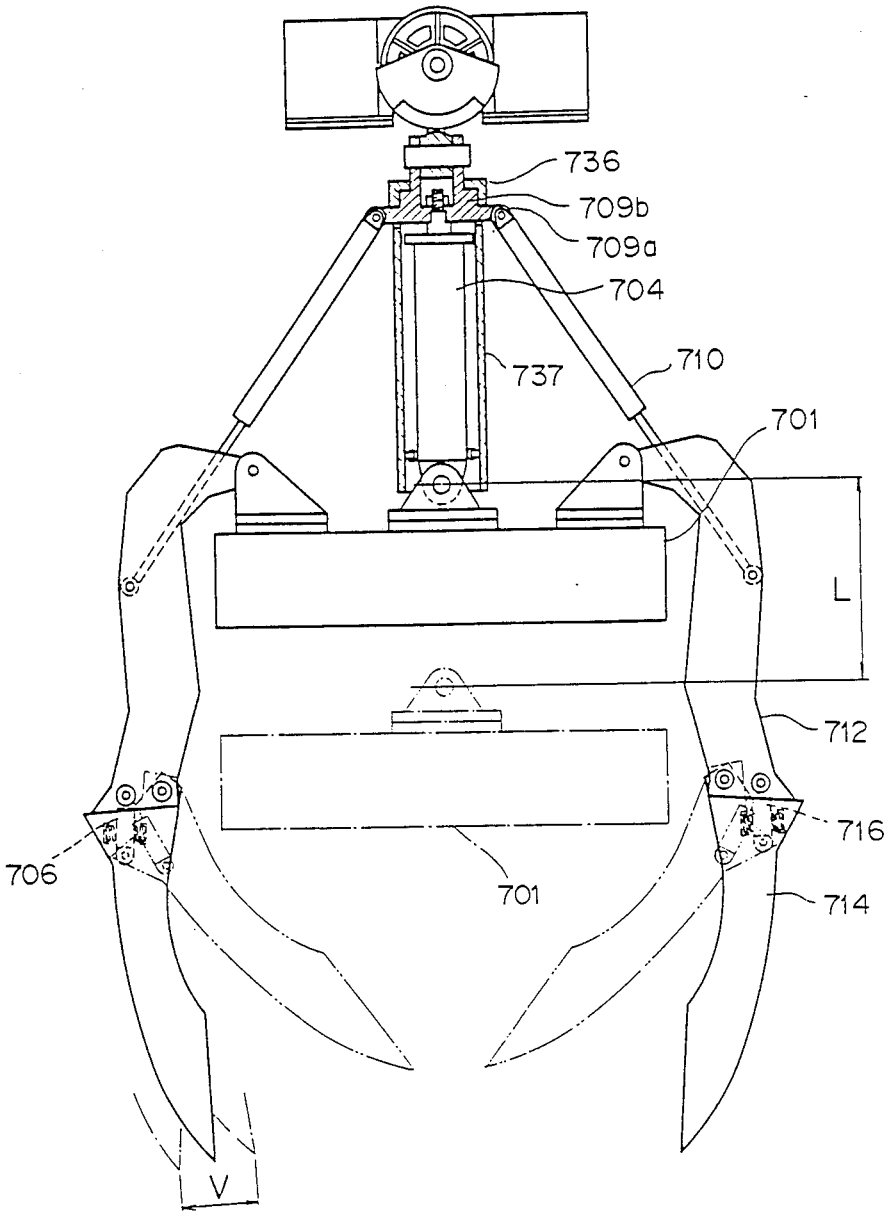
Figure 38:
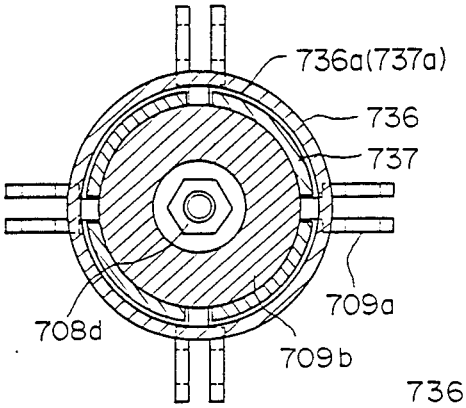
FIG. 38 is a sectional view taken on line C—C in FIG. 37.

The piston rod of the main power cylinder 704 is reciprocated and the free ends of the second arms 714 are reciprocated in the range V of about 200 mm as shown in FIG. 36 to thrust the second arms 714 deep into articles to be lifted, and then the piston rods of the hydraulic cylinders 716 are projected to grip the articles with the gripping arm assemblies.

The sixth and seventh embodiments are capable of gripping an increased amount of articles, because the second arms 714 are vibrated and thrusted deep into the heap of articles, and then the second arms are closed to grip the articles.

The seventh embodiment is particularly advantageous in operation at a place where only a narrow lifting space is available, because the lifting magnet 701 is lowered as the gripping arm assemblies are closed for gripping motion.

Furthermore, since the second arms 714 of the sixth and seventh embodiments are thrusted into the heap of articles in a substantially vertical position depending from the first arms, the sixth and seventh embodiments are particularly advantageous for use for gripping articles loaded on a truck having a narrow body.

An eighth embodiment of the present invention will be described hereinafter with reference to FIGS. 43 to 59.

Figure 43:
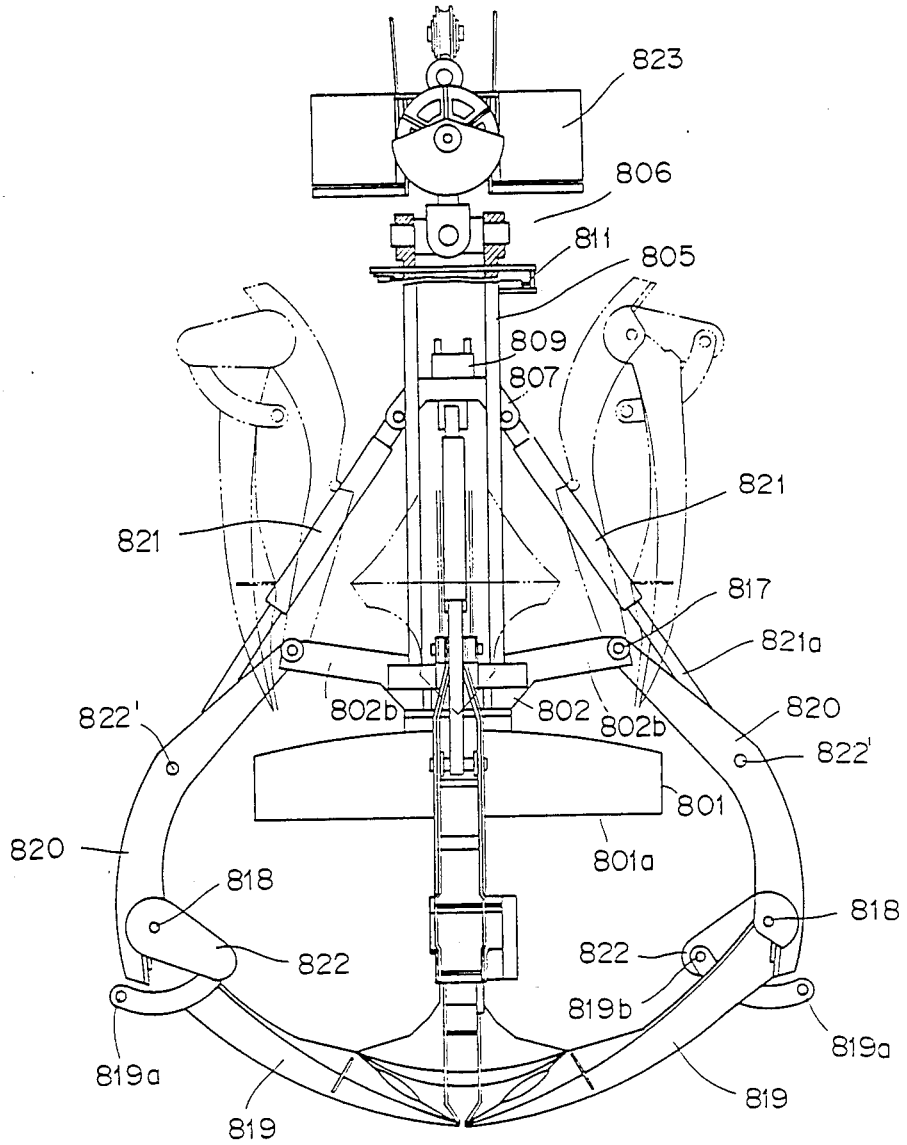
FIG. 43 is a general front elevation of an eighth embodiment of the present invention.
Figure 44:
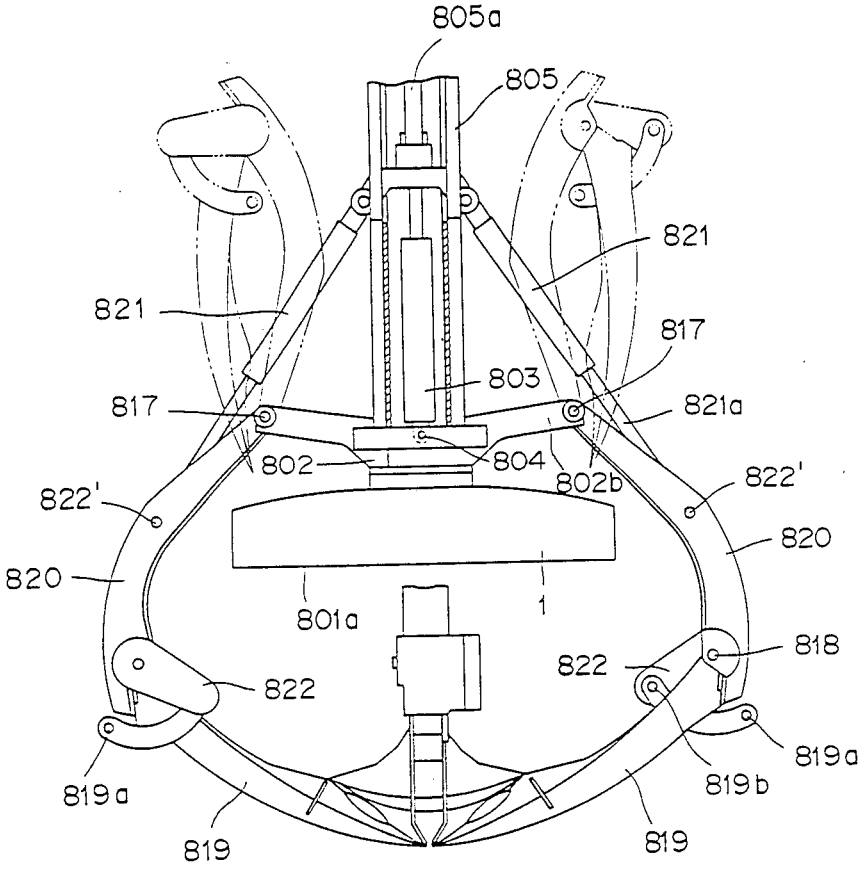
FIG. 44 is a partly sectional view similar to FIG. 43.
Figure 45:
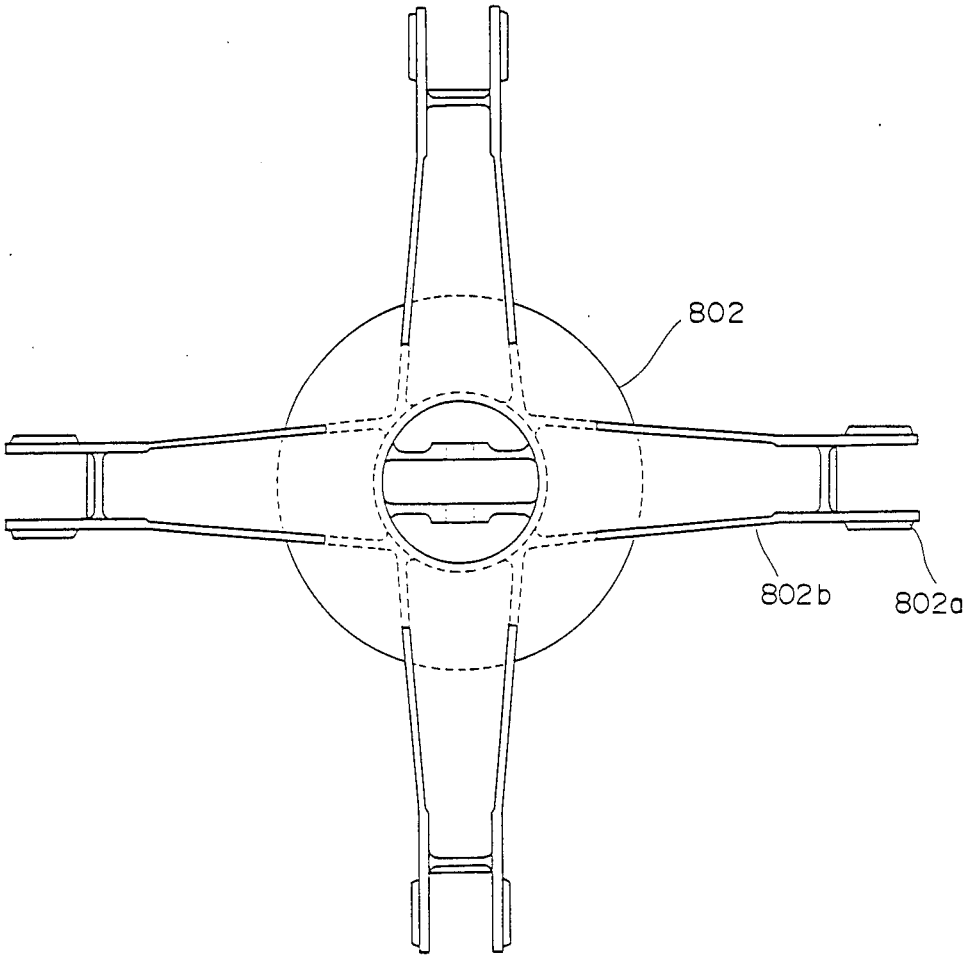
FIG. 45 is a plan view of a spider bracket employed in the eighth embodiment.
Figure 46:
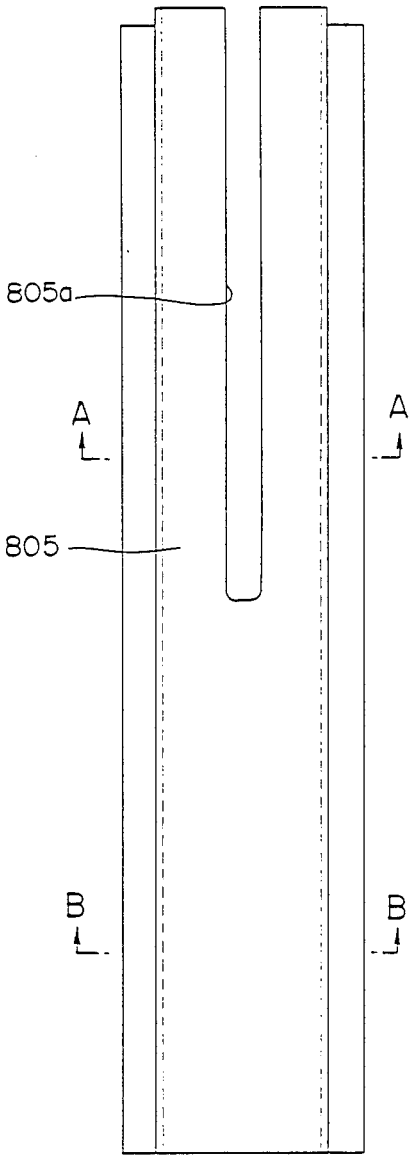
FIG. 46 is a front elevation of a main column employed in the eighth embodiment.
Figure 47:
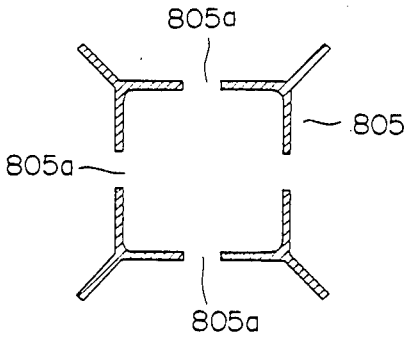
FIGS. 47 and 48 are sectional views taken on line A—A and on line B—B in FIG. 46.
Figure 48:
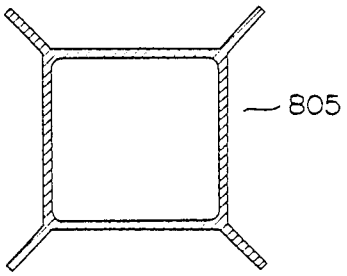
Figure 51:
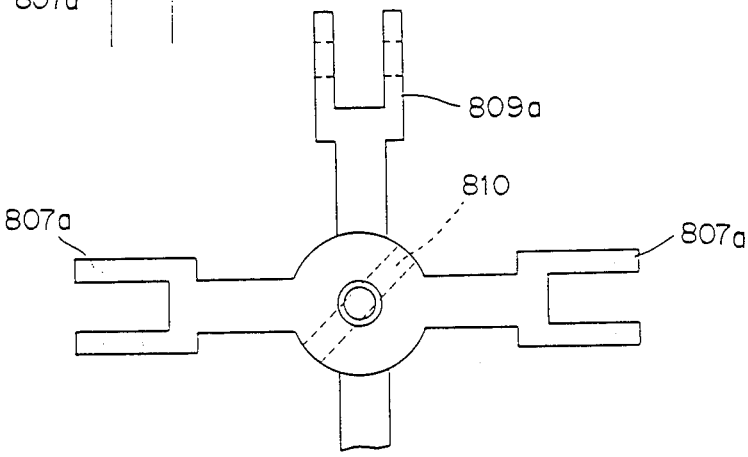
FIG. 51 is a plan view of the upper spider block of FIG. 49.

Referring to FIGS. 43 and 44, a main bracket 802 is attached to the central portion of the upper surface of a lifting magnet 801 opposite the attracting surface 801a of the same. The main bracket 802 has four radial arms 802b extending radially outward and each having a bifurcation 802a formed in the free end thereof. A main power cylinder 803 is joined pivotally at 804 to the central portion of the upper surface of the main bracket 802. A square main column 805 having guide slots 805a formed in the upper half of each side wall thereof is fixed to the upper surface of the main bracket 802. A trunnion assembly 806 is attached to the upper end of the main column 805. An external thread 803b is formed in the circumference of the free end of the piston rod 803a of the main power cylinder 803. A lower spider block 807 having two bifurcate arms 807a and an internal thread 807b formed in the central portion thereof is screwed on the free end of the piston rod 803a and a nut 808 is screwed on the free end of the piston rod 803a to lock the lower spider block 807 to the piston rod 803a. The outer circumference of the nut 808 fits the inner circumference of an upper spider block 809 having two bifurcate arms 809a extending perpendicularly to the bifurcate arms 807a of the lower spider block 807 as shown in FIG. 51. A hole 810 for receiving a pin 812 is formed through the upper spider block 809 and the nut 808. The pin 812 is inserted into and pulled out from the hole 810 by a pin control mechanism 811. A bifurcation 809b for closely receiving a boss 813 projecting from the bottom surface of the trunnion assembly 806 is formed at the upper end of the upper spider block 809. A hole 814 for receiving a pin 816 is formed through the bifurcation 809b and the boss 813 of the trunnion assembly 806. The pin 816 is inserted into and pulled out from the hole 814 by a hydraulic cylinder 815.

Figure 52:
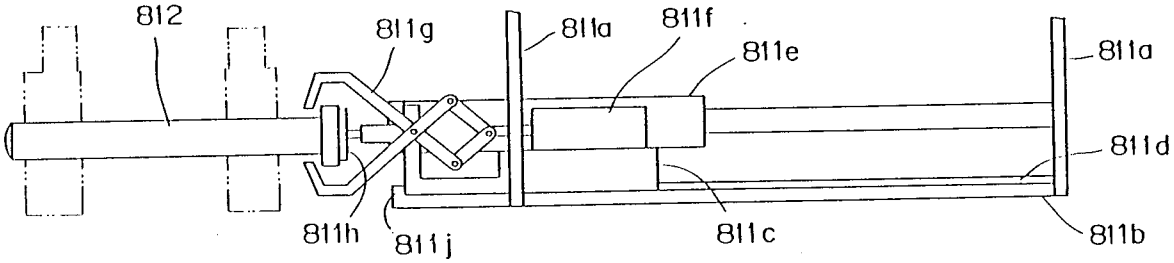
FIG. 52 is a front elevation of a pin control mechanism employed in the eighth embodiment.
Figure 53:
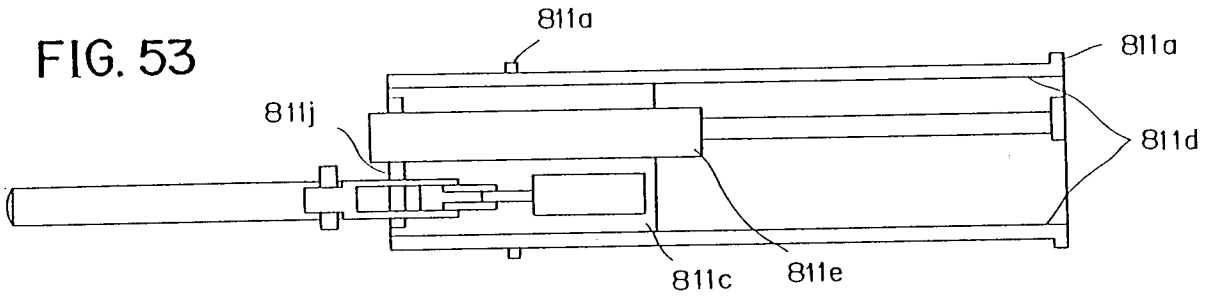
FIG. 53 is a plan view of the pin control mechanism of FIG. 52.
Figure 54:
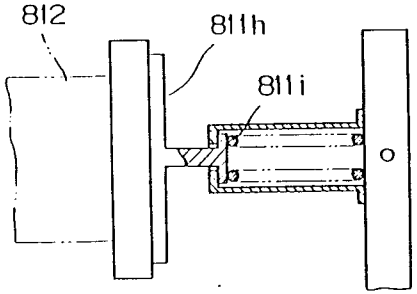
FIG. 54 is a schematic illustration of assistance in explaining the construction of a contact plate.

FIGS. 52, 53 and 54 illustrate the pin control mechanism 811. A base plate 811b is suspended by legs 811a depending from the bottom surface of the trunnion assembly 806. Guide slides 811d for guiding a sliding base 811c are formed in the opposite side surfaces of the base plate 811b. The sliding base 811c is moved in opposite directions along the guide slides 811d by a hydraulic cylinder 811e. A clamping device 811g which is operated by a hydraulic cylinder 811f for clamping and unclamping the pin 812 is mounted on the sliding base 811c. A contact plate 811h is held in contact with one end of the pin 812 by the resilience of a spring 811i. A stopper 811j limits the forward movement of the sliding base 811c.

The cylinders of two auxiliary power cylinders 821 among four auxiliary power cylinders 821 are joined pivotally with pins to the extremities of the bifurcate arms 807a, while the cylinders of the rest of the auxiliary power cylinders 821 are joined pivotally with pins to the extremities of the bifurcate arms 809a, respectively. Each of fourfirst arms 820 has one end joined pivotally with a pin 817 to the extremity of the bifurcate arm 802a of the main bracket 802 and the other end pivotally joined with a pin 818 to a second arm 819. The free end of the piston rod 821a of the auxiliary power cylinder 821 is joined pivotally with a pin 822' to the middle portion of the first arm 820. Thus, the first arms 820 are turned by the main power cylinder 803 and the auxiliary power cylinders 821 between a position above the lifting magnet 801 indicated by alternate long and two short dashes lines, where the first and second arms are folded, and a position below the lifting magnet 801 indicated by continuous lines, where the first and second arms are extended, respectively (FIG. 43).

Figure 56:
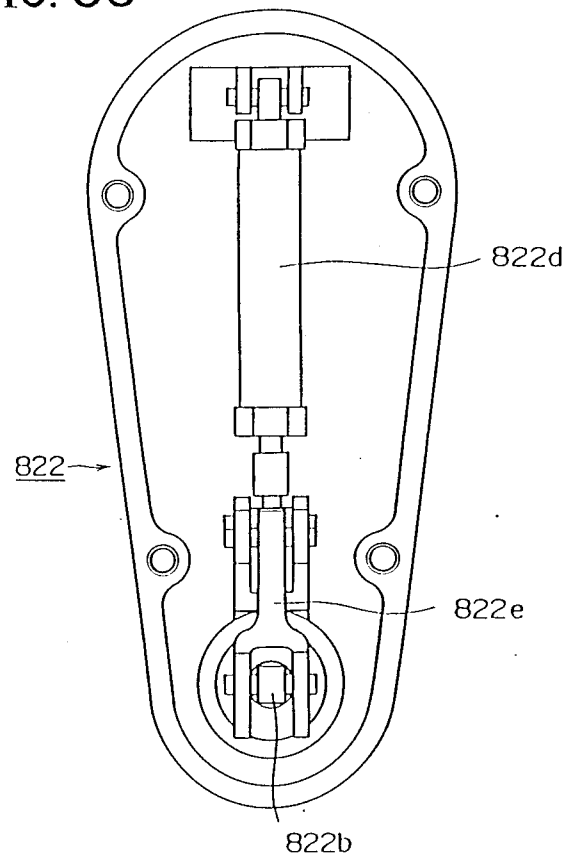
FIG. 56 is a side elevation of the locking mechanism of FIG. 55.
Figure 55:
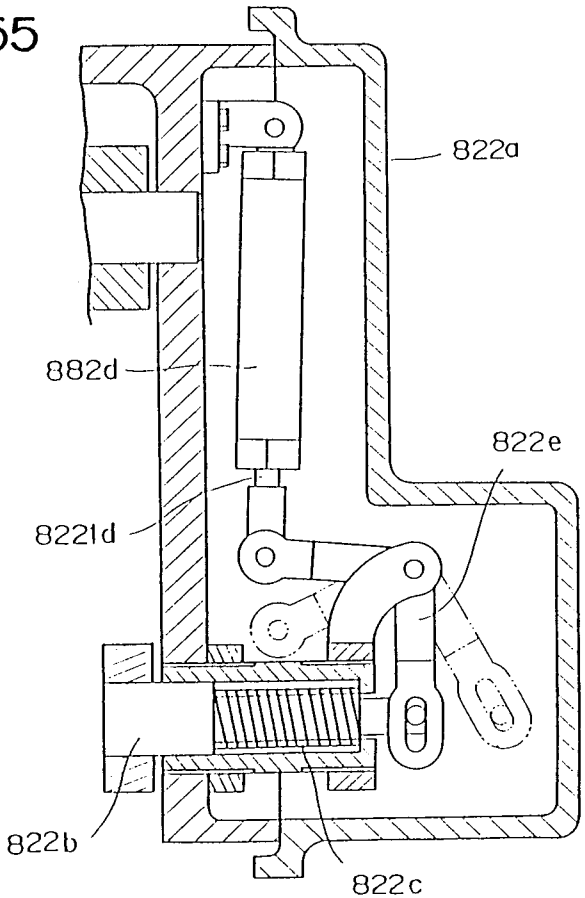
FIG. 55 is a front elevation of a locking mechanism employed in the eighth embodiment.

A locking mechanism 822 illustrated in FIGS. 55 and 56 is provided on each first arm 820. The locking mechanism 822 comprises a casing 822a, a locking pin 822b axially movably supported on the casing 822a so as to be inserted into and pulled out from a hole 819a or 819b formed in the second arm 819 (FIG. 43), a spring 822c biasing the locking pin 822b toward the second arm 819, a hydraulic cylinder 822d for axially moving the locking pin 822b against the resilience of the spring 822c, and an L-shaped lever 822e interconnecting the locking pin 822b and the piston rod 822d of the hydraulic cylinder 822d. In locking the second arm 819 by the locking mechanism 822, the piston rod 822d is retracted to allow the locking pin 822b to be inserted into the hole 819a or 819b by the resilience of the spring 822c and, in unlocking the second arm 819, the piston rod 822d is projected to pull out the locking pin 822b from the hole 819a or 819b against the resilience of the spring 822b.

Figure 57:
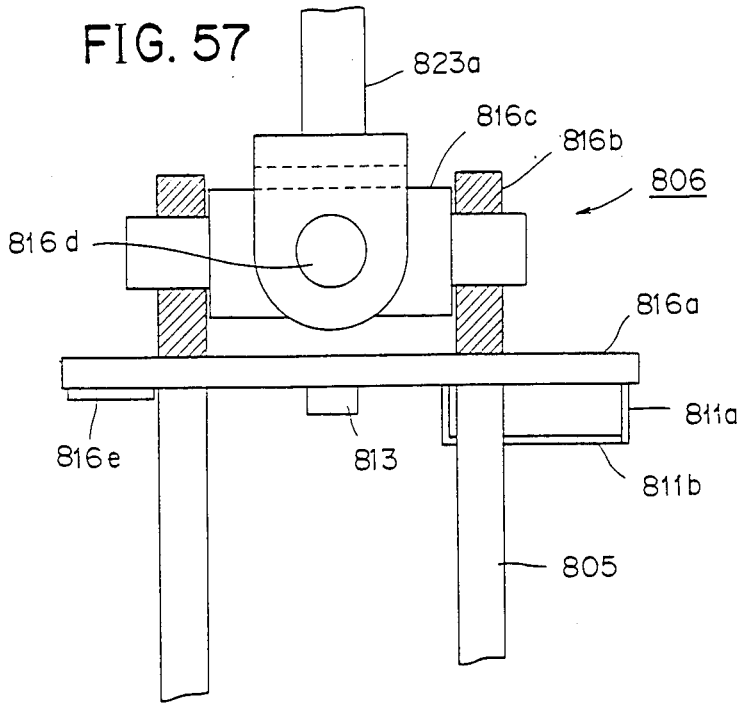
FIG. 57 is a front elevation of a trunnion employed in the eighth embodiment.

As illustrated in FIG. 57, the trunnion assembly 806 comprises a base 816a fixed to the upper end of the main column 805 fixed to the main bracket 802, a bearing member 816b provided on the base 816a, and a shaft 816c rotatably supported on the bearing member 816b. Pins 816d projected diametrically in opposite directions from the central portion of the shaft 816c. The shaft 816c is joined pivotally by the pins 816d to the rotary shaft 823a of a rotative driving mechanism 823. The boss 813, the base plate 811b suspended by the legs 811a, and a seat 816e for seating the hydraulic cylinder 815 are formed on the bottom surface of the base 816a.

Figure 59:
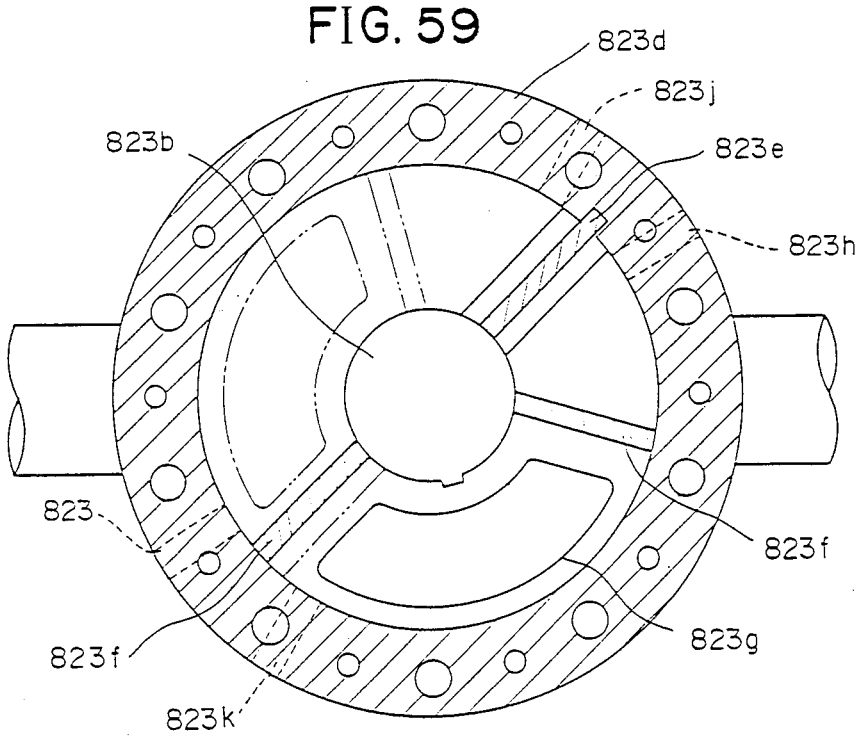
FIG. 59 is a plan view of the rotative driving mechanism of FIG. 58.
Figure 58:
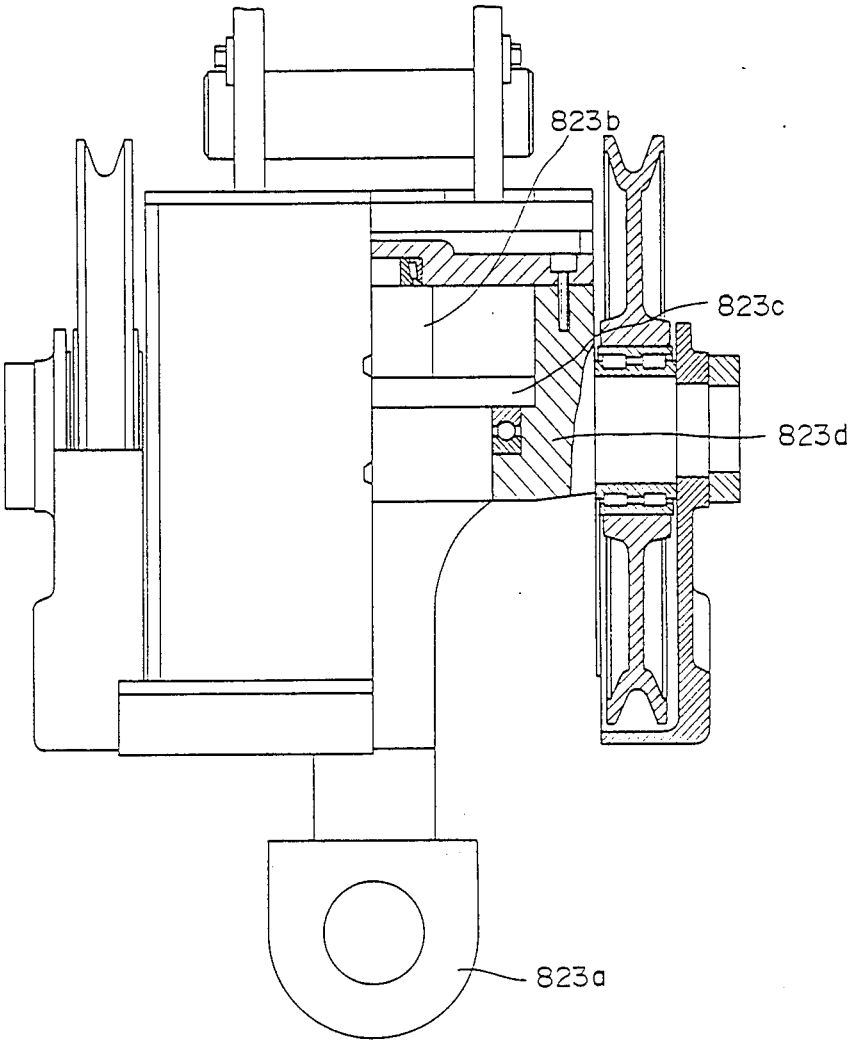
FIG. 58 is a partly sectional front elevation of a rotative driving mechanism employed in the eighth embodiment.

As illustrated in FIGS. 58 and 59, the rotative driving mechanism 823 comprises the rotary shaft 823a having an upper end 823b and a flange 823c, a sealed cylinder 823d accommodating the upper end 823b and the flange 823c of the rotary shaft 823a, a partition plate 823e partitioning a space defined by the inner circumference of the cylinder 823d and the outer circumference of the upper end 823b of the rotary shaft 823a, and a sectoral rotor 823g provided at the opposite ends thereof with sealing members 823f closely contacting the inner circumference of the cylinder 823d and fixed to the upper end 823b of the rotary shaft 823a. Inlet ports 823h and 823j are formed in the peripheral wall of the cylinder 823d near one end of the partition plate 823e on the opposite sides of the same, while outlet ports 823k and 823l are formed in the peripheral wall of the cylinder 823d near the other end of the partition plate 823e on the opposite sides of the same. When the working fluid is supplied through the inlet port 823h into the cylinder 823d, the sectoral rotor 823g is turned from a position indicated by continuous lines to a position indicated by alternate long and two short dashes lines. Consequently, the trunnion assembly 806, hence the mechanism suspended from the trunnion assembly 806, is turned by the rotary shaft 823a about the axis of rotation of the rotary shaft 823a. When the working fluid is supplied through the inlet port 823j into the cylinder 823d, the trunnion assembly 806, hence the mechanism suspended from the trunnion assembly 806, is turned in the opposite direction by the rotary shaft 823a.

In operation, the four gripping arm assemblies each comprising the first and second arms, or the two gripping arm assemblies are used selectively. In gripping fragmentary articles, the four gripping arm assemblies are used and, in gripping elongate articles, the two gripping arm assemblies are used.

Use of the four gripping arm assemblies:

The upper spider block 809 is released from the boss 813 by pulling out the pin 816 from the hole 814 by retracting the piston rod of the hydraulic cylinder 815, and the pin 812 is inserted into the hole 810 formed through the upper spider block 809 and the nut 808 to combine the upper spider block 809 and the lower spider block 807 in a four-arm spider block. The pin 812 is inserted into the hole 810 in the following manner. When the pin 812 is positioned outside the hole 810, the piston rod of the hydraulic cylinder 811f is retracted to grip the pin 812 with the clamping device 811g, and the piston rod of the hydraulic cylinder 811e is retracted to position the sliding base 811c at the rear end position (right-hand end). The piston rod of the hydraulic cylinder 811e is projected to move the sliding base 811c to the front end position (left-hand end) where the sliding base 811c comes into contact with the stopper 811j, and thereby the pin 812 clamped by the clamping device 811g is inserted into the hole 810 formed through the upper spider block 809 and the nut 808. Then, the piston rod of the hydraulic cylinder 811f is projected to release the pin 812 from the clamping device 811g, and then the piston rod of the hydraulic cylinder 811e is retracted to move the sliding base 811c together with the clamping device 811g to the rear end position.

Then, the position rods 822d of the hydraulic cylinders 822d are projected to pull out the locking pins 822b from the holes 819a of the second arms 819, so that the second arms 819 are unlocked from the first arms 820, respectively. Then, the piston rods of the auxiliary power cylinders 821 are projected to turn the first arms 820 on the pins 817, respectively. Since the second arms 819 depend from the first arms 820 by the agency of the dead weight thereof, the second arms 819 open relative to the first arms 820 as the first arms are turned outward, respectively. Upon the coincidence of the locking pins 822b with the holes 819b of the second arms 819, respectively, the locking pins 822b are inserted into the holes 819b by the resilience of the springs 822c, respectively. Thus, the second arms 819 are locked to the corresponding first arms 820.

In this state, the lifting magnet 801 is magnetized to gather articles by attraction, and then the piston rod of the main power cylinder 803 is retracted to shift the combination of the upper spider block 809 and the lower spider block 807 downward so that the first arms 820 and the second arms 819 are moved to a position indicated by continuous lines in FIG. 43. Then, the lifting magnet unit with a gripping mechanism is raised, and then the lifting magnet unit with a gripping mechanism holding articles is moved horizontally to transport the articles to a desired place.

Figure 49:
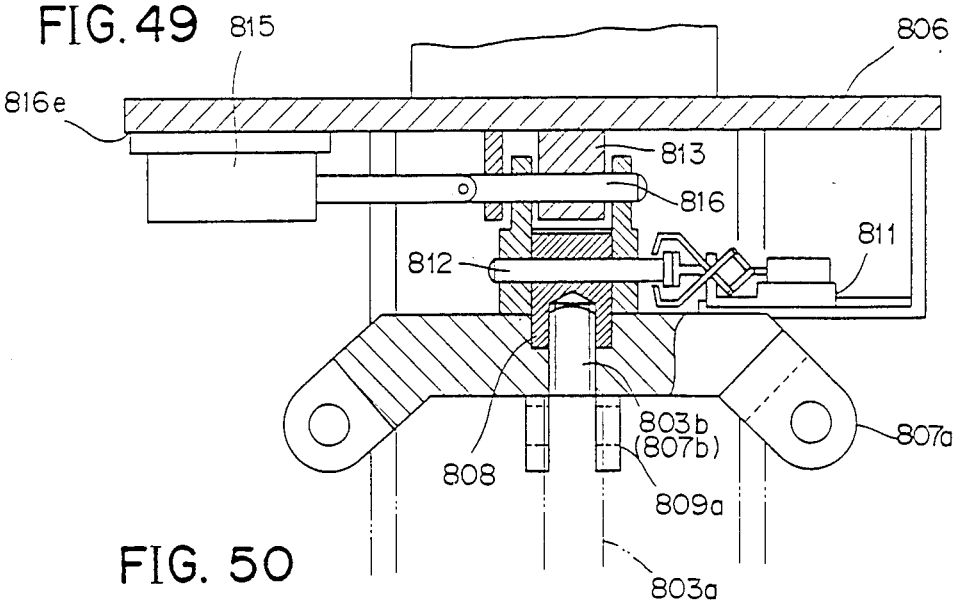
FIG. 49 is a front elevation showing the disposition of an upper spider block employed in the eighth embodiment.
Figure 50:
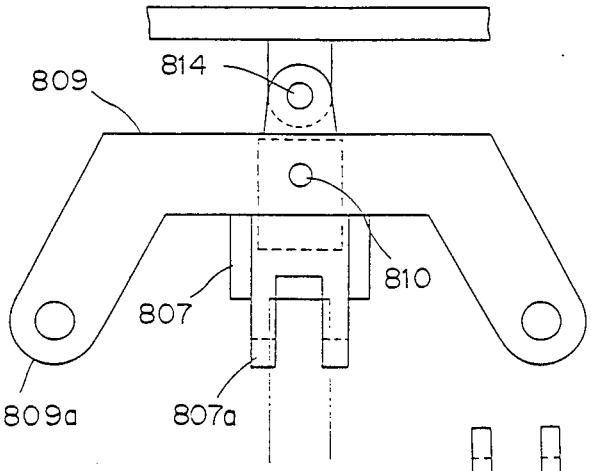
FIG. 50 is a side elevation of the upper spider block of FIG. 49.

Use of two gripping arm assemblies:

The piston rod of the main power cylinder 803 is projected to move the upper spider block 809 upward to a position shown in FIG. 49. Then, the piston rod of the hydraulic cylinder 815 is projected to insert the pin 816 into the hole 814 formed through the upper spider block 809 and the boss 813, and then, the pin 812 is clamped by the clamping device 811*g* and the clamping device is retracted to pull out the pin 812 from the upper spider block 809, so that the upper spider block 809 is released from the lower spider block 807 and is joined to the boss 813 with the pin 816. Thus, the first arms 820 and the second arms 819 of the two gripping arm assemblies are folded and stored at a position indicated by alternate long and two short dashes lines in FIG. 43.

On the other hand, the main power cylinder 803 and the auxiliary power cylinders 821 pivotally joined to the first arms 820 pivotally joined to the lower spider block 807 are actuated for elongate article gripping operation. The direction of the two gripping arm assemblies can be adjusted properly according to the direction of extension of the elongate articles by means of the rotative driving mechanism 823.

Thus, the eighth embodiment is able to handle elongate articles as well as fragmentary articles without difficulty by using the two gripping arm assemblies among the four gripping arm assemblies. Furthermore, the configuration of the lifting magnet unit with a gripping mechanism can be easily altered between a configuration with the two gripping arm assemblies and a configuration with the four gripping arm assemblies by operating the pins by the hydraulic cylinders.

As is apparent from what has been described hereinbefore, since the lifting magnet unit with a gripping mechanism according to the invention comprises a lifting magnet and hydraulically controlled gripping arm assemblies, there is no danger from the lifted articles falling even if power supply to the lifting magnet is interrupted during the lifting operation and, since the insufficiency of attraction of the lifting magnet or the reduction of attraction of the lifting magnet is supplement by the gripping arm assemblies, the lifting magnet unit with a gripping mechanism may be equipped with a small and lightweight lifting magnet, and hence the weight of the lifting magnet unit with a gripping mechanism can be reduced.

Although the invention has been described in its preferred forms with a certain degree of particularlity, it is to be understood that many variations and changes are possible in the invention without departing from the scope and spirit thereof.

What is claimed is:

1. A lifting magnet unit with a gripping mechanism, which comprises: a lifting magnet; a bracket attached to the upper surface of the lifting magnet opposite the attracting surface of the same; a screw rod supported upright and rotatably at one end on the bracket; a base plate disposed at the other end of the screw rod; a motor for rotating the screw rod, disposed on the base plate; a frame fixed at the lower end to the bracket and at the upper end to the base plate; a spider block having an internally threaded center hole engaging the screw rod; and a plurality of gripping arm assemblies each comprising a first arm pivotally joined at one end thereof to the extremity of one of the arms of the bracket with a pin, a second arm pivotally joined at one end thereof to the other end of the first arm with a pin, a rod pivotally joined at one end thereof to the spider block with a pin and at the other end thereof to the middle part of the first arm with a pin, and a locking mechanism for locking the second arm to the first arm by inserting a pin into a hole formed in the second arm.

2. A lifting magnet unit with a gripping mechanism as recited in claim 1, wherein said locking mechanism comprises: a sectoral plate partly fixed to the side surface of the first arm so as to be in sliding contact with the side surface of the second arm when the first arem turns on the pin; a solenoid fixed to the upper portion of the sectoral plate; a lever pivotally supported at the middle part thereof by a supporting leg on the sectoral plate with one end thereof diposed near the solenoid; a pin pivotally joined to the other end of the lever and supported so as to be axially movable; and a spring biasing the pin toward the second arm so that the pin is inserted into a hole formed in the second arm when the pin is aligned with the hole.

3. A lifting magnet unit with a gripping mechanism, which comprises: a lifting magnet which produces an attraction when magnetized and loses the attraction when demagnetized; a plurality of gripping arm assemblies each comprising a first arm pivotally joined at one end to the lifting magnet, a second arm pivotally joined to the other end of the first arm and capable of folding over or into the first arm, and a locking mechanism for locking the second arm to the first arm; a main power cylinder unit disposed on the upper surface of the lifting magnet; a pluraltity of auxiliary power cylinder units each having a cylinder pivotally joined to the main power cylinder unit, and a piston rod pivotally joined to the first arm; a cross-shaped trunnion disposed above the main power cylinder unit for swingably suspending the gripping arm assemblies and the lifting magnet; and a rotative driving mechanism detachable joined to the cross-shaped trunnion, for turning the gripping arm assemblies and the lifting magnet.

4. A lifting magnet unit with a gripping mechanism as recited in claim 3, wherein said locking mechanism comprises: a casing provided on the first arm; a locking pin supported on the casing so as to be inserted into one of the holes formed in the second arm, a spring biasing the locking pin toward the second arm; a hydraulic cylinder for moving the locking pin against the resilience of the spring; and an L-shaped lever for interconnecting the piston rod of the hydraulic cylinder and the locking pin.

5. A lifting magnet unit with a gripping mechanism as recited in claim 3, wherein said rotative driving mechanism comprises: a rotary shaft having an upper end and a flange; a sealed cylinder accommodating the upper end and the flange of the rotary shaft and provided in the peripheral wall thereof with inlet ports for receiving the working fluid therein and outlet ports for discharging the working fluid; a partition plate partitioning a space defined by the inner circumference of the cylinder and the outer circumference of the upper end of the rotary shaft; a sectoral rotor fixed to the upper end of the rotary shaft; and sealing members attached to the opposite sides of the sectoral rotor so as to be in close contact with the inner circumference of the cylinder.

6. A lifting magnet unit with a gripping mechanism, which comprises: a lifting magnet which produces an attraction when magnetized; a main power cylinder unit pivoting joined at the lower end to the upper surface of the lifting magnet; a four-arm spider block fixed to the free end of the piston rod of the main power cylinder unit; auxiliary power cylinder units each having a cylinder pivotally joined at one end to the four-arm spider block; and gripping arm assemblies each comprising a first arm pivotally joined at one end to the lifting magnet and at the middle part to the free end of the piston rod of the auxiliary power cylinder unit, a second arm pivotallly joined at one end to the first arm and capable of folding over the first arm, and a locking mechanism for locking the second arm to the first arm.

7. A lifting magnet unit with a gripping mechanism as recited in claim 6, wherein said locking mechanism comprises:

a casing provided on the first arm;

a locking pin supported on the casing so as to be inserted into one of the holes formed in the second arm, a spring biasing the locking pin toward the second arm;

a hydraulic cylinder for moving the locking pin against the resilience of the spring; and an L-shaped lever for interconnecting the piston rod of the hydraulic cylinder and the locking pin.

8. A lifting magnet unit with a gripping mechanism as recited in claim 6, wherein said rotative driving mechanism comprises:

a rotary shaft having an upper end and a flange;

a sealed cylinder accommodating the upper end and the flange of the rotary shaft and provided in the peripheral wall thereof with inlet ports for receiving the working fluid therein and outlet ports for discharging the working fluid;

a partition plate partitioning a space defined by the inner circumference of the cylinder and the outer circumference of the upper end of the rotary shaft;

a sectoral rotor fixed to the upper end of the rotary shaft; and sealing members attached to the opposite sides of the sectoral rotor so as to be inclose contact with the inner circumference of the cylinder.

9. A lifting magnet unit with a gripping mechanism, which comprises: a lifting magnet which produces an attraction when magnetized; a main power cylinder unit joined to the upper surface of the lifting magnet; a lower spider block fixed to the free end of the piston rod of the main power cylinder unit; an upper spider block capable of being detachably joined to the lower spider bracket; an upper spider block operating mechanism for joining the upper spider block to and for disjoining the same for the lower spider block; gripping arm assemblies each comprising a first arm pivotally joined at one end to the lifting magnet, a second arm pivotally joined at one end to the other end of the first arm, an auxiliary power cylinder unit having a cylinder pivotally joined at one end to the upper or lower spider block and a piston rod pivotally joined at the free end to the first arm, and a locking mechanism for locking the second arm to the first arm.

10. A lifting magnet unit with a gripping mechanism as recited claim 9, wherein said locking mechanism comprises:

a casing provided on the first arm;

locking pin supported on the casing so as to be inserted into one of the holes formed in the second arm, a spring biasing the locking pin toward the second arm;

a hydraulic cylinder for moving the locking pin against the resilience of the spring; and an L-shaped lever for the interconnecting the piston rod of the hydraulic cylinder and the locking pin.

11. A lifting magnet unit with a gripping mechanism as recited in claim 9, wherein said rotative driving mechanism comprises:

a rotary shaft having an upper end and a flange;

a sealed cylinder accommodating the upper end and the flange of the rotary shaft and provided in the peripheral wall thereof with inlet ports for receiving the working fluid therein and outlet ports for discharging the working fluid;

a partition plate partitioning a space defined by the inner circumference of the cylinder and the outer circumference of the upper end of the rotary shaft;

a sectoral rotor fixed to the upper end of the rotary shaft; and sealing members attached to the opposite sides of the sectoral rotor so as to be in close contact with the inner circumference of the cylinder.

12. A lifting magnet unit with a gripping mechanism which comprises: an electromagnetic lifting member which produces an attraction when energized, said electromagnetic lifting member having a top surface and a bottom surface; first power cylinder means pivotally attached to said top surface of the electromagnetic lifting member, said first power cylinder means having a guide pipe section and a rod section adapted to slidably extend through said guide pipe section and having a lower end pivoted to said top surface of the electromagnetic lifting member; a spider block attached to said guide pipe section at an upper end thereof; gripping arm assemblies radially arranged around said rod section of the first power cylinder means, each gripping arm assembly including a first arm having a first end and a second end and a second arm having a first end and second end, said first arm being pivoted to the top surface of the electromagnetic lifting member at said first end thereof to be adapted to hang downward from the lifting member, said second arm being pivoted to the second end of the first arm; a second power cylinder means pivoted to said spider block and the first arm of each gripping assembly to take first and second positions such that each first arm is pulled upward to permit the entire gripping arm assemblies to collapse in said first position whereas each first arm is allowed to hang downward from the lifting member in the second position; a hydraulic cylinder provided at said first end of said second arm and having a piston rod; means for locking said piston rod to the second end of the first arm; and suspension means for suspending the spider block and allowing revolution and rocking about vertical and horizontal axes.

13. A lifting magnet unit with a gripping mechanism according to claim 12, wherein said locking means includes a pinion and rack mechanism attached to the first arm, said pinion and rack mechanism including a pinion and a toothed pin meshed with said pinion; and a hole formed in the piston rod of the hydraulic cylinder; and piston rod positioning means for guiding the piston rod to bring said hole in the piston rod in alignment with said toothed pin.

14. A lifting magnet unit according to claim 12, wherein said suspension means includes a rotary shaft having an upper end and a flange; a sealed cylinder accommodating the upper end and the flange of the rotary shaft and provided in the peripheral wall thereof with inlet ports for receiving the working fluid therein and outlet ports for discharging the working fluid; a partition plate partitioning a space defined by the inner circumference of the cylinder and the outer circumference of theupper end of the rotary shaft; a sectoral rotor fixed to the upper end of the rotary shaft; and sealing members attached to the opposite sides of the sectoral rotor so as to be in close contact with the inner circumference of the cylinder.

* * * * *